US007705826B2

(12) United States Patent
Kalt et al.

(10) Patent No.: US 7,705,826 B2
(45) Date of Patent: Apr. 27, 2010

(54) FLEXIBLE VIDEO DISPLAYS AND THEIR MANUFACTURE

(75) Inventors: Charles G. Kalt, Williamstown, MA (US); Thomas F. Kalt, Shutesbury, MA (US); Robert Miller, The Villages, FL (US); William G. Seeley, Williamstown, MA (US); Mark S. Slater, North Adams, MA (US)

(73) Assignee: New Visual Media Group, L.L.C., Eatontown, NJ (US)

( * ) Notice: Subject to any disclaimer, the term of this patent is extended or adjusted under 35 U.S.C. 154(b) by 869 days.

(21) Appl. No.: 10/503,967

(22) PCT Filed: Feb. 10, 2003

(86) PCT No.: PCT/US03/03882

§ 371 (c)(1),
(2), (4) Date: Sep. 6, 2006

(87) PCT Pub. No.: WO03/069593

PCT Pub. Date: Aug. 21, 2003

(65) Prior Publication Data

US 2007/0052636 A1 Mar. 8, 2007

(51) Int. Cl.
*G09G 3/34* (2006.01)

(52) U.S. Cl. ..... 345/109; 349/62

(58) Field of Classification Search ..... 345/204, 345/205, 690, 214, 108, 109, 110, 111; 349/58, 349/62, 65, 67

See application file for complete search history.

(56) References Cited

U.S. PATENT DOCUMENTS 4,336,536 A 6/1982 Kalt et al.
4,383,255 A * 5/1983 Grandjean et al. ..... 345/109
4,488,784 A 12/1984 Kalt et al.
4,915,486 A * 4/1990 Hansen ..... 349/24
4,978,952 A * 12/1990 Irwin ..... 345/102
5,231,559 A 7/1993 Kalt et al.
5,519,565 A 5/1996 Kalt et al.
5,554,434 A 9/1996 Park et al.
5,629,790 A 5/1997 Neukermans et al.
5,638,084 A 6/1997 Kalt
6,057,814 A 5/2000 Kalt
6,075,639 A 6/2000 Kino et al.
6,081,304 A 6/2000 Kuriyama et al.
6,229,509 B1 5/2001 DeLuca et al.
6,557,279 B2 5/2003 Araki et al.

(Continued)

*Primary Examiner*—Amr Awad
*Assistant Examiner*—Stephen G Sherman
(74) *Attorney, Agent, or Firm*—Lerner, David, Littenberg, Krumholz & Mentlik, LLP

(57) ABSTRACT

A flat panel display has a linear array of switchable light emitting diodes ("LEDs") to emit bands of light across the display, providing a light pattern programmable at video frequencies and a two-dimensional electropolymeric shutter array to convert the light pattern into a video image. The light pattern can be varied or controlled spatially, with respect to both hue and intensity, by suitable drive signals, at points along the array determined by the location of individual LEDs, or groups of LEDs, and temporally as the shutters in the array are opened and closed to provide a pleasing full color gamut for every pixel in the display. Closed shutters, displaying a reflective appearance, can be employed for background or other effects. The shutter array can be flexibly constructed and supported on a flexible substrate to provide a flexible display.

33 Claims, 19 Drawing Sheets

U.S. PATENT DOCUMENTS 6,559,827 B1 * 5/2003 Mangerson ..... 345/102
6,590,626 B1 * 7/2003 Suzuki et al. ..... 349/70
2002/0054033 A1 * 5/2002 Nakamura et al. ..... 345/204

* cited by examiner

ASSEMBLY OF SHUTTER ARRAY 12 WITH CHANNEL PLATE 15

VIDEO DRIVE METHOD

Figure 14
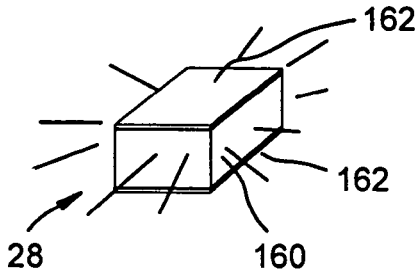
Figure 15
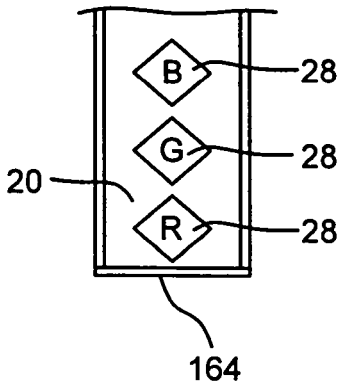
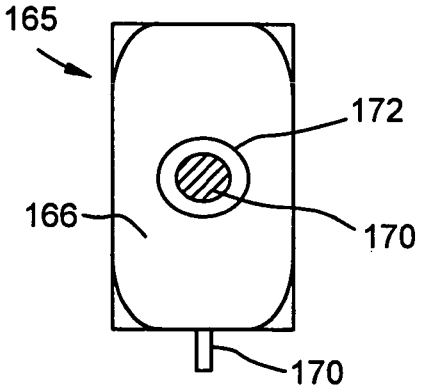
Figure 18
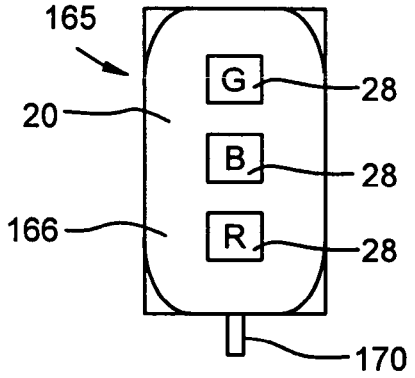
Figure 17
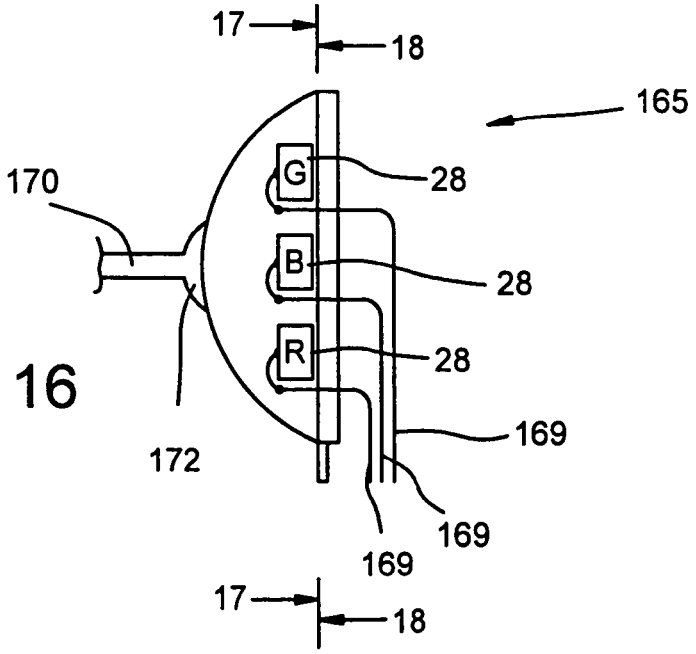
Figure 16

FLEXIBLE VIDEO DISPLAYS AND THEIR MANUFACTURE

BACKGROUND OF THE INVENTION

1. Field of the Invention

This invention relates to electronically driven video displays for displaying computer, television or other informational or entertainment images or text which displays can have flexible shape enabling novel displays according to the invention to be curved, rolled, flexed or folded. The inventive displays can be embodied in a wide variety of forms, including high definition television monitors, laptop and desktop computer monitors, cell phone displays, sports stadium displays, highway signs and the like, in conventional configurations, and also in novel, variable form configurations. The invention also relates to the manufacture of such displays.

2. Description of Related Art

Including Information Disclosed under 37 CFR 1.97 and 37 CFR 1.98

In the emerging information age, at the beginning of the twenty-first century, video display panels are commonplace household and office items appearing in many forms. Brilliant full-color screens radiate real time or recorded action images from large areas of home theater walls, of Times Square buildings and from sports stadia scoreboards. Compact-monochrome panels communicate important daily trivia from phones, cars, ovens and other appliances. And few businessmen, scientists or teachers can properly practice their professions without the ubiquitous personal computer and its accompanying display. Nor is a home considered complete without one, or more likely, several television monitors. As the burgeoning Internet drives an exponential growth in communications, and as intelligent devices proliferate, video display panels will emerge into ever more market niches.

Surprisingly, prior to this invention, the display device is, all too often, a bulky, heavy, resource-hungry, energy-consuming cathode ray tube. Though alternative technologies proliferate, they either lack picture quality or are more expensive, limiting their fields of use. There has accordingly long been a need for compact, low resource, energy efficient display panels.

A drawback of conventional displays known to the present inventors is that they have a fixed form, typically comprising a rigid rectangular display panel which provides the viewed display area. The extent of the desired display area thus sets a minimum size parameter on devices incorporating the display panel, the rigidity and geometric permanence of which requires the display panel geometry to be maintained from the factory to the user and for the life of the device. Given the appeal of large screen video displays, and for other reasons, it would be desirable to have flexible or shapable displays capable of adopting a form more compact than their displayed extent when not in use. For example, it would be especially attractive to provide a portable computer display that could be rolled, curved or even folded into a more compact form than conventional laptop computers, which typically have a footprint of about 30 cm (12 in) by about 23 cm (9 in).

There is accordingly a need for a display technology which can adapt to emerging market needs, can solve the problem of providing a flexible video display, or display panel, capable of conforming to more than one useful geometric configuration, and which can meet ordinary present day criteria for a full color video display. It would furthermore be desirable to provide a display technology which can be used to produce low cost, energy efficient, thin, flat panel, full-color video displays in conventionally rigid structures.

It is an insight, or understanding, of the present invention, that a limiting feature of known display technologies is the employment of electronically controlled pixel size light modulating elements in the display area. The light-modulating elements can, for example, be tricolor groups of light-emitting phosphors, in cathode ray or plasma displays, organic light-emitting diodes, tricolor groups of electrostatically shuttered filters, active matrix liquid crystal display elements and so on. A drawback of such displays is their reliance upon side-by-side RGB subpixels to achieve full color which limits the light output. The display intensity, or luminance of displayed primary colored images is limited by the need for an individual subpixel to illuminate the area of the group of three (or possibly four) subpixels, and manufacturing is complicated.

In many so-called "flat panel" display technologies, perhaps more clearly referenced as "thin panel", or "thin, flat panel" display technologies, which avoid the bulk weight and energy-consuming drawbacks of cathode ray tube ("CRT") devices, the light-modulating elements are synthesized in situ on a display panel substrate being a support structure for the eventual display. Such synthesis of electronically controllable optically active elements requires expensive techniques such as sputtering, vapor deposition, etching, and the like, may require exotic or exceptionally pure materials and the fabricated elements may be subject to contamination by ordinary structural materials such as common plastics materials that it would be desirable to use for substrates. In addition to the expense and manufacturing difficulties, the materials needed for synthesis of active devices, and the restraints on the substrate materials that can be used, may effectively impose requirements of rigidity on the end product display panel.

Furthermore, such known flat panel display technologies require x-y addressing of individual pixels employing extended conductor patterns and raising multiplexing issues resulting from the electrical cross-coupling of the rows and columns in the display medium. Various more or less complex drive schemes, can be used to inhibit cross-coupling, also known as "cross talk". In addition to their cost, such measures may limit luminance, contrast or gray scale quality or the ability to refresh the display at video rates. As an alternative, an active matrix drive system can be used.

In a matrix display, driven by rows and columns, the pixels represent potential leakage paths from driven rows and columns to undriven rows and columns. Such leakage is the cause of cross talk. Some display media have a substantial threshold characteristic such that the signals that pass through to undriven rows and columns are below this threshold and do not affect the luminance and contrast. For display media with an insufficiently steep threshold, an active matrix can be used to provide a sharp threshold. This threshold sharpens the distinction between an "on" and an "off" pixel so that, for instance, a half-addressed pixel will not light, while a fully addressed pixel will. Cross-coupling in a display with an indistinct threshold can cause a display to partially illuminate when or where it is not intended to illuminate. However, if the threshold is sharp enough, small signals arising from cross coupling do not exceed the threshold and do not deleteriously affect display operation. An active matrix drive system, which usually incorporates one or more transistors at each pixel, provides a desired sharp threshold characteristic isolating the signal from the undriven rows and columns and avoiding activation of unaddressed pixels by spurious signals.

However, active matrix displays are relatively expensive. In addition, active matrix technologies, used in organic light-emitting diode ("OLED") displays, and some liquid crystal displays ("LCD"), have other drawbacks. For example, fabrication of an active matrix display on a flexible substrate can be particularly difficult. Plastics are permeable to many impurities that can damage active elements or phosphors. Barrier layers needed for active matrices, even on glass, complicate manufacture and have been shown to delay damage rather than provide complete protection.

High yield, thin film transistor ("TFT") fabrication on a glass substrate to yield a quality product having good dimensional stability requires substantial capital investment. Fabrication on a dimensionally variable plastic substrate, if successfully developed, would require even greater investment. Such processes typically require the substrate to be heated, creating difficulties with plastic substrates which may change their dimensions, deleteriously affecting the alignment of components in subsequent masking steps.

In the case of passive technologies for LCD, OLED or other displays the fabrication of long, narrow row or column electrodes from transparent conductive materials for example indium tin oxide ("ITO" herein), with sufficient current carrying capability for operation of a matrix display can be expected to present significant technical difficulties because of the limited conductivity of the transparent materials. Unavoidably high resistances in long conductors may cause line access times to be unduly high and cause excessive power consumption and heat generation.

Nor are passive matrix supertwist LCDs well suited to fabrication on or assembly with flexible plastic substrates because they require small and well controlled cell gap spacings. Other liquid crystal technologies, including ferroelectric, cholesteric and bistable nematic devices, being passive displays, require currents at video rates and power levels that are difficult to supply on flexible substrates with known transparent conductors.

Difficulties are expected in attempting to use phosphors, such as are employed in laser-based polymer flat panel displays and OLEDs, on a flexible plastic substrate, because phosphors require a protected environment to prevent degradation. CRTs use phosphors in a vacuum; plasma phosphors are contained in an inert gas at low pressure; and EL phosphors are sandwiched between insulating layers. These protected phosphor devices can have long lifetimes, whereas unprotected phosphors have rather short lives.

As taught, for example, in U.S. Pat. Nos. 4,336,536, 4,488,784, 5,231,559, 5,519,565, 5,638,084 and 6,057,814, the disclosures of which are hereby incorporated herein by reference thereto, over a period of several decades, inventor Kalt herein has developed electronically driven electropolymeric video displays that employ, as light shutter components of individual pixels, light-modulating capacitors having movable electrodes. The movable electrode is formed of metallized polymer film and is coiled, or otherwise prestressed, into a compacted, retracted position from which it can be advanced across a dielectric member by application of a drive voltage. The drive voltage is controlled by a fixed electrode on the other side of the dielectric member, the movable and fixed electrodes and the dielectric member constituting a variable capacitor.

Matrix arrays of such electropolymeric shutters are particularly suitable for use in electronic video displays because they can be fabricated from low-cost commercially available materials, consume little energy, are durable and are operable at video speeds. Of particular interest to a specific object of the present invention, electropolymeric shutter arrays, as taught by Kalt, can be embodied in flexible and shaped configurations.

Kalt '084 discloses a passive electropolymeric display ("EPD") comprising a shutter array, constructed as just described, in front of a pixellated color screen having side-by-side red, green, blue and white cells aligned with the electropolymeric shutters. The display employs reflective color filters to be viewable by backlighting transmitted through the display and by reflected ambient light to have good visibility in both bright daylight and in subdued or dim interior light. This "indoor-outdoor" Kalt display is susceptible to low-cost web or sheet based manufacture, does not employ exotic materials or manufacturing processes, is low-weight and energy efficient and can be embodied in thin flat panels. Furthermore, they are compatible with flexible plastic substrates. In fact, the relatively high shrinkage coefficient of suitable synthetic polymeric plastics materials which would be problematic with other technologies is actually helpful to the fabrication of prestressed coiled shutter elements for electropolymeric shutter arrays. However, the light output of such electropolymeric displays is limited by the side-by-side subpixel configuration and a further drawback is the need for x-y addressing, or multiplexing of the shutter array.

In summary, there is a need for a for a low cost, low energy, video display capable of good luminosity or light output. Thin, flat panel, full color embodiments of such a display would be particularly desirable. There is also a need for flexible embodiments of such a display which can adopt different geometric forms, and there are still further needs for such displays that are capable of being manufactured from low cost materials and components by mass production methods.

SUMMARY OF THE INVENTION

To solve the problem of filling one or more of the needs described above, the invention provides a pixellated electronic display comprising a plurality of linear pixel arrays, each linear pixel array including a light guide extending along the pixel array. The light guides each have a longitudinally extending optical volume and a longitudinal light outlet extending along the optical volume. Furthermore, the light guides are arranged cooperatively, one with another, to provide a display area. The display further comprises, for each light guide a light source to provide a light beam traveling along the optical volume, the light source being electronically switchable between active and inactive states and a linear array of light-deflecting elements, one for each pixel, disposed along the light guide and operable to deflect a light beam traveling along the optical volume to emerge through the light outlet toward a viewer of the display area. At each pixel, the deflected light beam is effective to change the pixel appearance.

The use of light guides enables a single light source to serve a linear array of shutters and enables high output, but relatively expensive light sources, for example, light-emitting diodes to be economically employed. The light channels can distribute light from the source to a multiplicity of pixels in the linear array, thus avoiding the expense and practical difficulties of furnishing separate light sources at each pixel.

The simplicity of construction of the inventive display in the display area avoids many of the difficulties described hereinabove with other technologies, lends itself to embodiment in flexible constructions and furthermore permits use of a flexible support substrate. Thus, the invention can provide a high-performance full-color geometrically flexible display.

The invention enables a single row (or column, if desired) of electronically drivable LEDs to be employed as light sources and to be disposed outside the display area, enabling the display area components and materials to be fabricated as a passive unit and then assembled with the active light source components. Other electronically drivable light sources than LEDs may be employed, for example, packaged RGB sources, laser sources, piped sources, fiber optic sources, and the like.

Some advantages of such inventive displays are that there is no need for electronic device synthesis on a substrate, nor for the complexities of electronic x-y addressing, or multiplexing. Furthermore, pixel hue and luminance can be controlled simply by electronically modulating the drive levels of a linear array of suitable red, blue and green LEDs.

The invention is particularly applicable to video displays, for example computer or television monitors, for which purpose the light-deflecting elements can each comprise a movable shutter element having a reflective-surface, each said shutter element being movable between an operative position where the light beam is reflected by the shutter element to emerge through the light outlet toward the viewer and a default position where the light beam is not reflected. Preferably, in the default shutter position, the reflective surface of each shutter element is presented to the viewer and the shutter element closes a respective light outlet.

With no need for an active matrix, nor light-emitting or -modulating elements over the area of the panel, the electrically passive, electromechanical nature of the scanning elements results in low cost fabrication technology, low temperature processing, achievable dimensional tolerances without dependence upon high technology, difficult to fabricate materials or patterns.

Because the invention can electrically decouple the rows and columns of the display from one another, the only interaction between the rows and columns that is required by the drive electronics is to synchronize the opening of the rows with the modulation of the columns. This feature permits great flexibility in designing each of the components for optimum performance.

Preferred embodiments of the invention avoid long, narrow conductor structures, which may have excessive resistances. Instead, preferred embodiments can be constructed employing a single large transparent conductive layer electrode covering the entire active area of the display. Such extended area, or wide area conductors, permit use of presently available transparent conductor materials. Alternatively, if desired, a small number of electrodes, such as two or four may be employed, each covering a substantial and preferably equal portion of the display area. Such wide, large area electrodes can comprise commercially available ITO-coated plastic sheets having relatively high resistivity (for example greater than 500 ohm/sq.) that meet component flexibility requirements for a flexible display panel.

Some examples of devices that can include the inventive displays or display panels include large area, high resolution computer and television monitors, and special-purpose ruggedized and flexible displays for a variety of command and control applications, including military uses.

Thus, it may be understood that preferred embodiments of the invention comprises a flexible electropolymeric video display which has no critical active materials or devices fabricated on, or in, the display area. The display area comprises passive, sheet or roll fabricated layers which are assembled into the display structure. Suitable layer materials are various synthetic polymers, for example. polyethylene naphthalate, polyethylene terephthalate and polypropylene, are not subject to degradation by moisture or common atmospheric contaminants. Such preferred display devices can be fabricated in high yield by simple manufacturing processes. Known, commercially available LEDs can be used as light sources and can be positioned essentially outside the display area, for example at the edge of the display area, projecting their light beams into the display. Though novel, the required addressing technique for the preferred display is simple and straightforward and does not depend on critical electrooptic parameters of a display medium.

Such preferred embodiments of the invention provide a flexible display with excellent performance characteristics which can be produced in a simple low-cost manufacturing process that avoids many of the substrate and fabrication problems associated with conventional light modifying or light emitting flat panel display technologies. Flexible electropolymeric displays according to the invention can be made using relatively simple web-based processes to assemble available light-emitting diode light source products with electropolymeric shuttering technology provided pursuant to the teachings of inventor Charles G. Kalt, herein.

Broadly stated, the invention provides an electronic video display comprising a plurality of longitudinally extending switchable light columns arranged contiguously one beside the other, each light column comprising:

a) a light channel extending along the column;

b) a switchable light source capable of outputting a light beam along the light channel; and c) a line of light shutters extending alongside the light channel, each light shutter being operable to deflect light from the light beam to travel transversely of the light column toward a viewer.

To this end, in another aspect, the invention provides a method of manufacturing a pixellated electronic display wherein light from each of a plurality of light sources can be distributed along light channels to an array of electrostatically actuated shutters, the method comprising:

a) assembly of an array of electrostatically actuatable shutter elements from polymeric film and conductive materials;

b) assembling the shutter array with a channelized light guide member having a plurality of parallel light channels alignable with the shutter elements; and c) assembling at least one light source with each light channel.

If desired, as referenced above, the materials employed and the display produced can both be flexible. For mass production, the inventive method can be embodied in a continuous web manufacturing process using commercially available coated and uncoated polymeric film materials to provide the shutter element array. Alternatively a sheet-fed manufacturing process may be employed.

The invention also provides a method of displaying a pixellated video image in a display area, which method comprises:

a) projecting a series of optically modulatable light beams from an array of light sources in side-by-side parallel bands across the display area;

b) selectively deflecting each projected light beam toward the viewer at one of a series of points along the respective display band, the series of points corresponding with a line of pixels in the video image;

c) selectively deflecting each projected light beam toward the viewer at another of the series of points along the respective display band;

d) repeating step c) until each beam has been deflected at all points in the series; and e) modulating each light beam at the respective light source while performing steps b) and c) so that each of the points in the series along the parallel bands comprise pixels of the video image.

The display method can be implemented with relatively simple and economic apparatus, as described herein, to provide a high quality image, video or computer presentation, streaming video, motion picture or the like.

BRIEF DESCRIPTION OF THE DRAWINGS

One or more embodiments of the invention and, if not already described above, of the manner and process of making and using the invention, as well as the best mode contemplated of carrying out the invention, are described in detail below, by way of example, with reference to the accompanying drawings, in which:

FIG. 14 is a perspective view of an LED light source element suitable for use in the inventive video display panel of FIG. 1;

FIG. 15 is a portion of a view similar to FIG. 1 of a modified arrangement of an LED array disposed to illuminate a light channel;

FIG. 16 is a view on a plane parallel to its light channels of a modified LED array suitable for use in the inventive video display panel of FIG. 1;

FIG. 17 is a view on the lines 17-17 of the LED array shown in FIG. 16;

FIG. 18 is a view on the lines 18-18 of the LED array shown in FIG. 16;

DESCRIPTION OF THE PREFERRED EMBODIMENTS

Overview

Figure 1:
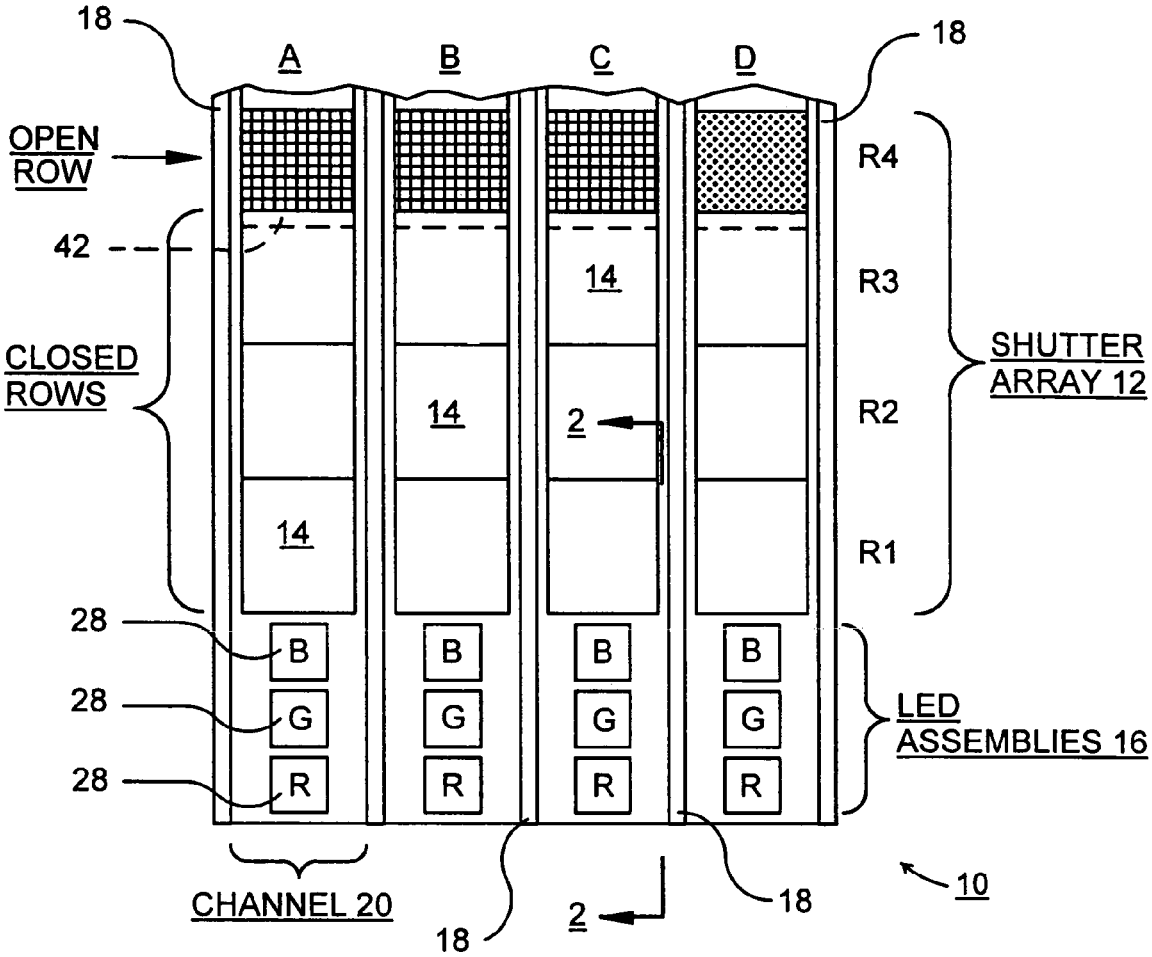
FIG. 1 is a schematic top view of a portion of one embodiment of an electronically driven video display panel according to the invention which can be provided as a flexible electropolymeric display.

A preferred high performance flexible display, according to the invention, can be constructed by combining a linear array of switchable light emitting diodes ("LEDs") to provide a band-like light pattern programmable at video frequencies with a two-dimensional electropolymeric shutter matrix array to convert the light pattern into a video image.

The light pattern can be varied or controlled spatially, with respect to both hue and intensity, by suitable drive signals, at points along the array determined by the location of individual LEDs, or groups of LEDs, and temporally as the shutters in the matrix array are opened and closed, to provide a pleasing full color gamut for every pixel in the display. Closed shutters, which are typically reflective, can be employed for background or other effects.

The display can have three distinct structural components, namely: the shutter matrix array; the LED array; and a substrate to support the LED and shutter arrays. A fourth component, which may comprise respective row and column subunits, is the drive electronics. Preferably, the substrate is channeled or channelized and provides optical coupling between the one-dimensional LED array and the two-dimensional shutter array.

Driver electronics, the row drivers for the shutter array and column drivers for the LEDs, or vice versa, and associated logic, can be mounted on or off the substrate, as desired. Optionally the row and column drivers can be physically separated electronically independent, but synchronized in operation.

The terms "row" and "column" are used herein as a convenient reference with the understanding that they can usually be interchanged, unless the context dictates otherwise.

Such a flexible electropolymeric display may consist of a plastic substrate, a two-dimensional array of electropolymeric shutters placed on top of the substrate and a linear array groups of three LEDs each, emitting red, green and blue (RGB), respectively, and being positioned at, or on, one end of the substrate to shine down channels along the surface of the substrate.

The electropolymeric shutter array preferred for use in the inventive display can be fabricated with openable reflective flaps according to processes taught by inventor herein, Charles G. Kalt, see for example his issued United States patents referenced above. Pursuant to the present invention, the controlled light patterns generated from a linear row of LEDs or, preferably a row of groups of red, green and blue LEDs, is transformed into a two-dimensional array through the use of channelized light guides aligned behind a two-dimensional electropolymeric shutter array. If desired, the channelized light guides may be supported on a substrate, The substrate can be a sheet of plastic, for example polyethylene terephthalate, which has ribs embossed on it, analogously to those on a plasma display substrate. Of particular significance is the fact that the substrate need have no electrodes on it, simplifying manufacture. If desired, a plastic substrate can be furnished with channel-defining ribs by embossing in a web process, for example as taught by 3M Company. The LED's can be placed in the channels between the ribs, at locations outside the display area, and shine down these channels.

The linear LED array can be mounted on a flexible strip and assembled with the substrate by snapping the strip, face down, into the channels. Preferably, the shutter array is a contiguous sheet with pixel-sized shutters cut in the sheet, which is bonded over the entire substrate area. Using electropolymeric technology the shutters are moved into the channels in synchronism with the pulsed LED light, by the application of a voltage signal. With each shutter disposed in its respective channel at an approximately 45 degree angle, the light from the LED in that channel is deflected upward and toward the viewer.

The light guides can comprise light channels formed in a support member which light channels are parallel to one another. The support member can comprise opaque divider walls optically separating adjacent light channels. Preferably also where the light sources have a non-collimated light output, the light channels have reflective inner surfaces throughout their optical lengths.

To communicate with the shutter array, each light outlet can comprise an optical opening along the optical length of a respective light guide and extending transversely of the divider walls. The light volume can be defined by a respective light outlet and by the inner surfaces of a light channel, all the light channel inner surfaces being reflective. Preferably, the light sources each comprise a light-emitting diode device at one end of a light channel, the light-emitting diode device being electronically drivable to emit a light beam into the light volume defined by the light channel.

In preferred embodiments, the light-deflecting elements each comprise a movable shutter element having a reflective surface, each shutter element being movable between an operative position where the light beam is reflected by the shutter element to emerge through the light outlet toward the viewer and a default position where the light beam is not reflected.

In a particularly preferred embodiment, in the default shutter position, the reflective surface of each shutter element is presented to the viewer and the shutter element closes a respective one of the light outlets. Also, each light source is operable to pulse the light beam in synchronism with operation of the shutters in the respective linear array whereby the light beam pulses are selectively deflected one by each shutter element in the respective linear array. Preferably, each light source is selectively operable to generate successive light pulses having different colors, each color being selected from a full color range and the selected light pulse is reflected to the viewer. Furthermore, each light source comprises a light-emitting diode device capable of separately emitting red light, green light and blue light and combinations of said red green and blue light.

In a synchronized manner, the light beams are deflected normally to the substrate by the shutter array. The light beams are pulsed to provide desired pixel characteristics and the resultant RGB light pattern exiting the substrate comprises the display image. The whole display may be incorporated in a thin, flat panel housing.

Preferably, in operation, one row at a time of video data is applied to the LED row by an LED drive signal. The light from the LEDs is piped along the channels beneath the electropolymeric shutter array and scanned downwardly over the display area by opening one row at a time of the electropolymeric shutter flaps with a timing pattern determined by a shutter drive signal and coordinated with the LED drive signal.

Preferably, the light sources are operated to pulse the light beam in synchronism with operation of the shutters in the respective linear array whereby the light beam pulses are selectively deflected, one by each shutter element, in the respective linear array. Preferably also, each light source is selectively operable to generate successive light pulses having different colors, each color being selected from a full color range, each successive light pulse being is reflected to the viewer. The light sources can be light-emitting diode devices capable of separately emitting red light, green light and blue light and combinations of said red green and blue light.

Of particular interest are displays constructed of flexible materials which are flexible about at least one axis, and optionally, able to be rolled up into a cylindrical or coiled compact form.

In another aspect, the invention provides an electronic display comprising:

a) a plurality of light-emitting rows of illumination;

b) a plurality of columns of light switches, each column extending across the rows of illumination and having a switch registering with each crossed row of illumination; and c) electronic drive circuitry to control the emission of light from the rows of illumination and to switch the light switches; wherein each light switch can be switched to pass light from the respective registering row of illumination toward a viewer.

In a further aspect, the invention provides an electronic display comprising:

a) a plurality of side-by-side illuminated channels, the illumination of each individual channel being variable independently of the illumination of other channels; and b) a plurality of rows of switches, each row having one switch for each channel of illumination;

wherein the switches are electronically switchable to direct light from the respective registering channel of illumination toward a viewer.

The invention also provides an electronic pixel comprising:

a) a pixel opening having a pixel area in a display plane, the pixel area being viewable by a viewer located on one side of the display plane;

b) an electrostatically actuated movable light shutter element having a reflective surface and being movable between a default position where the reflective surface extends across the display area to reflect ambient light to the viewer and an operative position where a light beam traveling behind the display plane, with respect to the viewer, is reflected through the pixel opening toward the viewer. A matrix array of such pixels can provide a video display panel, area or other component of a host structure.

Displays according to the invention can be embodied in a wide variety of electronic devices, for example, a television monitor, a computer monitor, a cellular phone, an information appliance, a traffic information sign, a sports scoreboard, a road, water, or air vehicle instrument, a road, water, or air vehicle instrument assembly, a location finder, a household appliance or an industrial appliance.

The term "electropolymeric" is used herein to connote the characteristics of having electrical activity, in the sense of being responsive to the application of a suitable applied electrical potential, and of being comprised of polymeric materials, which polymeric materials have a role in the electrical responsiveness.

Preferred Embodiments

In preferred embodiments, the invention provides a novel and unique display device in which the scanning and modulation functions of conventional flat panel displays are decoupled. Such decoupling enables the intensity of the display to be directly adjusted by simply increasing the magnitude of the light source drive signal, without significantly impacting addressing functionality.

Preferred embodiments of the invention also combine LED and electropolymeric shutter technologies into a novel design that makes effective use of the capabilities of both technologies. By employing a row of LEDs as the light source for the desired image, advantage is taken of the brightness, efficiency and speed of response of currently available LEDs. The invention contemplates that future technological improvements in LED technology will enable displays with increased brightness and efficiency to be provided.

Figure 2:
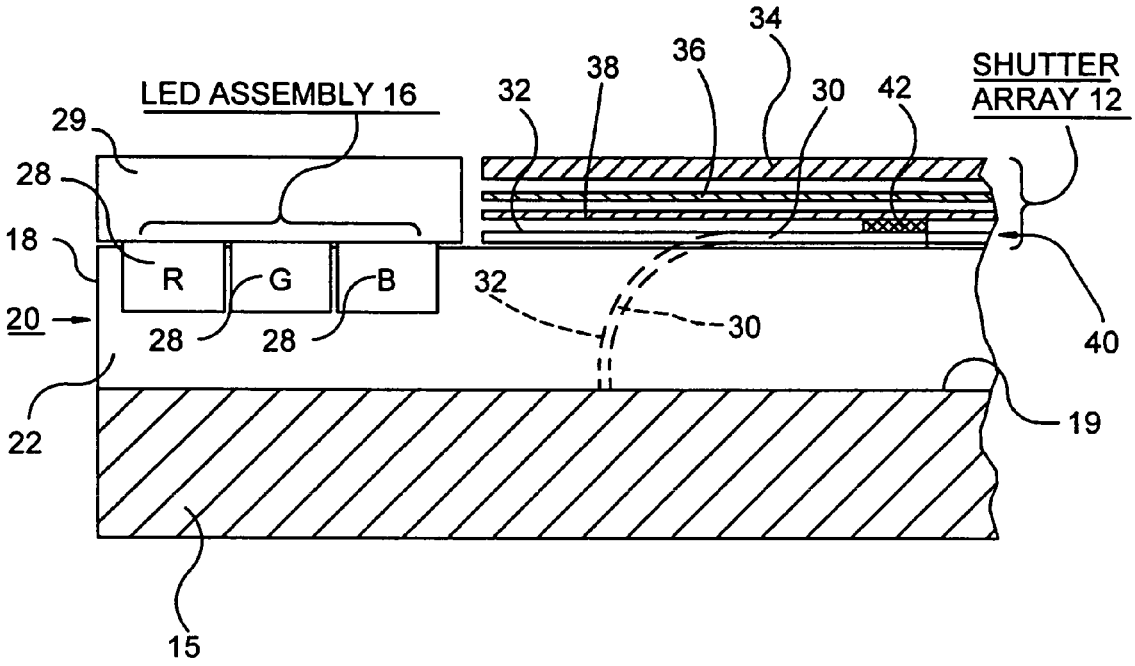
FIG. 2 is a schematic side view, partly in section, of the display shown in FIG. 1 with a light source mounting in place.

Referring to FIGS. 1 and 2, the illustrated video display panel 10 comprises a two-dimensional, orthogonal array 12 (or raster) of electronically actuatable square or rectangular light shutters 14, and a linear array of light sources, for example LED assemblies 16. In preferred orthogonal matrix array embodiments light shutters 14 are square. However, the invention provides the advantage that a rectangular display can, if desired, be fabricated with equal numbers of pixels in its columns and its rows, by employing rectangular pixels with proportions selected according to the desired display proportions.

Light shutter array 12 is supported on a substrate in the form of a channel plate 15 (see FIG. 2) with the array of LED assemblies 16 extending along one side of shutter array 12. LED assemblies 16 may also be supported on substrate 15, or may be separately supported. For convenient reference, the display will be assumed to be vertically disposed, with a viewer in front of it. Unless the context indicates otherwise, the term "outer" references structure that is closer to the viewer than "inner" structure, which is more distant. In use, the display may have any desired orientation, or disposition.

Channel plate 15 is provided with a series of parallel and equi-spaced vertically extending divider walls 18 upstanding from an outer surface 21 of channel plate 15 in the direction of the viewer. Adjacent pairs of divider walls 18 define, with substrate surface 21, parallel light channels 20, or light pipes, whose purpose is to guide light from the respective LED assembly 16 to the substrate side of the array of shutters 14. The spacing between walls 18 preferably approximately corresponds with the pixel width, while the height of walls 18 may have various values but is preferably about one half the pixel width. Light channels 20 are preferably constructed to optimize transmission of light along the channel.

Figure 3:
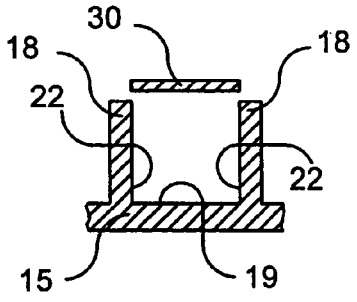
FIG. 3 is a cross-sectional view of a pixel being a component of the display shown in FIGS. 1 and 2.

Light channels 20 extend beneath shutter array 12 and each is dimensioned and aligned to register with one of the columns A-D etc. of shutters 14. As shown in FIG. 3, one embodiment of channel 20 has an approximately rectilinear U-shaped cross-section comprising vertical surfaces 22 of divider walls 18 and horizontal upper surface 24 of channel plate 15.

LED assemblies 16 can be mounted in cavities (not shown) at one end of each channel 20, and connected to an LED drive circuit. Flaps 30 are electrically connected together in rows R1-R4 running perpendicularly to channels 20.

Suitable drive circuitry is provided to selectively pulse the LEDs, according to the characteristics of an applied drive signal, and open shutters 14, one row at a time, in synchronism with the pulsed LED light, by the application of a voltage to the shutters, as will be explained in more detail hereinbelow. The row of open shutters 14 depend into their respective channels 20, at an acute angle of perhaps about 45° to shutter array 12, and deflect light emitted from the respective LED assembly 16 serving the channel, outwardly toward the viewer. The simple display structure of the invention has significant performance and manufacturing advantages.

Shutter Array 12

As will be discussed more fully hereinbelow, and is taught in one or more of my prior patents, each shutter 14 in shutter array 12 can have an electrostatically controllable shutter element which is anchored along one horizontal side of the shutter. The shutter element is flexible and can move, flexing or partially coiling, like a flap, to open the shutter. Reference numeral 14 is used to indicate a complete individual shutter including the electrical components required to operate the shutter, whereas reference numeral indicates only that element which is movable to modulate the passage of light through the shutter. The shutter elements are usually opaque so that a closed shutter blocks light from behind the shutter 14 from reaching the viewer, while an open, retracted shutter enables a light ray originating behind the shutter to reach the viewer. For this purpose, the shutter element preferably has a highly reflective outer surface (facing the viewer) to optimize the proportion of light from the source that can reach the viewer. If desired, the shutter element reflective surface may be selective. For example, orange shutters might be used with white light sources for an outdoor display such as a traffic message sign.

Figure 1A:
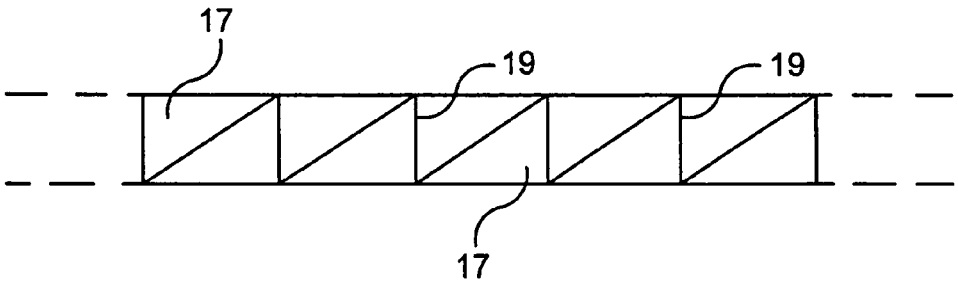
FIG. 1A is a schematic view of a portion of a modified embodiment of the display shown in FIG. 1.

Shutters 14 will usually be identical, one with another, but departures from this requirement will be, or become, apparent to those skilled in the art. For example, peripheral shutters might be a different size from the rest of the array, possibly larger. Alternatively, some shutter elements may have different reflectivity characteristics from others, for example, some may be colored to emphasize a portion of a message. In a further alternative, a pane of smaller shutters, providing a higher resolution can be provided for a special purpose, e.g. to provide a television viewing window in a computer monitor, or vice versa. In another modification, as shown in FIG. 1A, shutters 14 are configured as right triangles 17, each triangle 17 having its horizontally extending side anchored and the opposing apex of the triangle able to retract. Shutter triangles 17 are arranged and operated in pairs, each pair defining a pixel and the pairs being aligned in a column. More complex, and therefore more expensive, this arrangement may provide enhanced shutter controllability, especially at small apertures, where the apices of triangles 17 begin to retract.

Shutter array 12 defines the viewing area, or aperture, of display panel 10. It will be understood that only a small portion of one edge or corner of the display is shown. The remainder of the display may comprise any desired number of pixels arranged in rows and columns alongside the pixels shown, with an LED assembly 16 at the foot of each column, referencing the orientation of the display as shown in FIG. 1.

Preferably, the shutters 14 are contiguous, with minimal distance between one shutter and the next. It is also preferred that the aperture of the shutter, i.e. the open area through which light may be received to the viewer, occupy as large a proportion of the shutter area as is practicable so that the total apertured area is a high proportion of the display area.

Shutters 14 in shutter array 12 are arranged in rows R1, R2, R3, etc. and columns A, B, C etc., with one shutter 14 of every row registering with each light channel 20 so that every column of shutters 14 registers with a single light channel 20. In this manner, each channel 20 extends beneath a single column of shutters 14 so that light from a single LED group 16 can pass alongside each shutter 14 in the column. As shown, the groups of LEDs 16 are arranged along the bottom of the display, adjacent the lowermost row R1 of shutters 14, but this disposition is optional.

Figure 7:
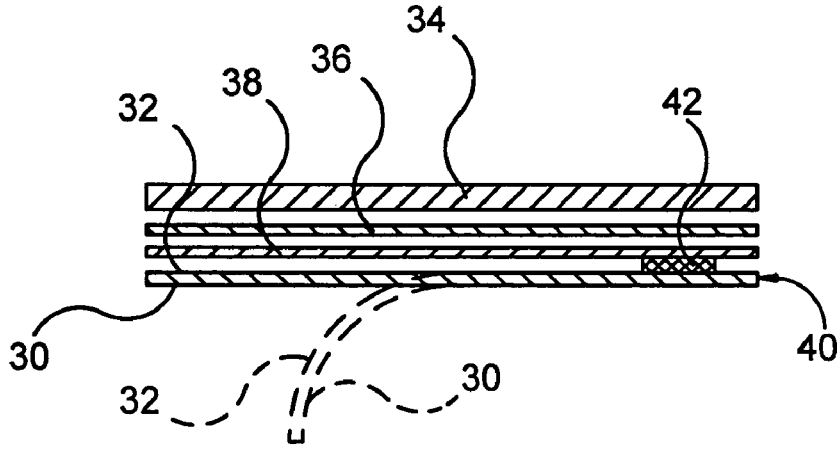
FIG. 7 is a cross-sectional view of a light shutter component of the display of FIGS. 4 and 5

One possible structure of shutter array 12, comprises layers of polymeric material treated with conductive materials to provide suitable electrical components. A preferred embodiment of such an array is illustrated in FIGS. 2 and 7 and is described more fully hereinbelow under the heading "Electropolymeric Shutters". The Kalt patents, referenced above, also contain relevant teaching regarding the design and fabrication of electrostatically driven polymeric film shutter arrays.

As shown in FIGS. 2 and 7, and to be further described, each light shutter 14 comprises a support substrate 34, a transparent conductive layer 36 on support substrate 34, a dielectric layer 38, in good electrical contact with the upper side of dielectric layer 38, and flexible polymeric flap 30. Reflective surface 32 is disposed to be viewer-facing and to contact the other side of dielectric layer 38. Flap 30 can be formed of a suitable commercially available metallized film, the metallization constituting reflective surface 32 and also providing conductivity. In addition, flap 30 is prestressed to stand away from dielectric layer 38, in the broken line position shown in FIG. 2. Application of a suitable voltage between conductive layer 36 and the metallized surface 32 of flap 30 capacitatively draws flap 30 into contact with dielectric layer 38, which adopts the full line position if an adequate voltage is sustained. Removal of the voltage causes flap 30 to curl away from dielectric 38, relaxing into the broken line position.

Channel Plate 15

The main structural component of the display is channel plate 15 which is a passive device providing only the support for the other components and containing channels 20 which act as three sides of the light pipes that convey light to the pixels. The fourth side of the light pipes will be the underside of flaps 30 which are preferably also reflective. Assuming flaps 30 are formed of transparent flexible polymer, aluminum coating 32 on the outer, dielectric-contacting surface of the flap may provide adequate reflection through the polymer. If better reflectivity is required in light channel 20, the inner surface of flaps 30 can be coated with aluminum or other reflective material. Use of a single reflective layer on inner, channel side of flap 30, which also serves as an electrode though possibly having optical advantages, is contemplated by the invention as being disadvantageous because of potential undesirable triboelectric effects arising from engagement and disengagement of an uncoated flap 30 with and from dielectric 38.

Channel plate 15 can support both shutter array 12 and LED assemblies 16 and can be formed of any suitable sheet material and is conveniently formed of a plastic material, for example polyethylene terephthalate ("PET" hereinafter) or the like. Since channel plate 15 is not an electrically functional component, it does not enter the electrical domain, so to speak, it can, if desired, be formed of metallic or even optical or optically coated material such as glass, treated for reflectivity. However such generally rigid materials will usually not be suitable for flexible displays.

The described embodiments of the invention do not call for light to be transmitted through any structural elements of channel plate 15 so that channel plate 15 can be opaque and pigmented, if desired. Preferably, channel plate 15 is polymeric and flexible to permit the display itself to be flexible or otherwise dimensionally adaptable. In addition to its support functions channel plate 15 serves as a channel plate defining light channels 20 which represent the columns of the display. The spacing of channel walls 18 corresponds to the pixel pitch and the top of the channel plate, or channel plate 15 is covered with shutter array 12. The active, inner side of shutter array 12, bearing flaps 30, faces channels 20 so that pixel flaps 30 can retract into the channels. The height of each channel 20 is chosen to be smaller than the flap length so that each retracted flap 30 closes off channel 20 against passage of light from the respective aligned LED assembly 16 past the retracted flap.

Comparable substrate structures may be found in plasma display devices and may be suitably adapted for use in the practice of the present invention. Channel plate 15 carries no electrodes on its surfaces, facilitating manufacture and enabling it to be formed from a single component, as a one-piece monolithic structure.

Preferably channel plate 15 is fabricated from a film-forming material, e.g. PET, enabling ribs 26 to be embossed or otherwise formed on the substrate, in a low-cost high-volume, continuous web manufacturing process. As shown, an assembly 16 of three LEDs 28 is placed at one end of each light channel 20, between ribs 26, where the LEDs can shine down or along the channel. Preferably, each LED assembly 16 comprises three LEDs 28 placed in each channel 20, creating an RGB display, operable as a full-color display.

Walls 18 may be incorporated as an integral feature of channel plate 15. While channel plate 15 may, if desired, be rigid, and optionally flat, it is a particular feature of the invention to provide a flexible substrate and housing for the pixel array to provide a flexible display. The novel features of the invention permit exceptionally thin and economical displays to be constructed and enable compact, esthetic and, if desired, portable embodiments. Preferred display embodiments of the invention can be conformed to a variety of shapes, as will be described more fully hereinbelow.

Figure 3A:
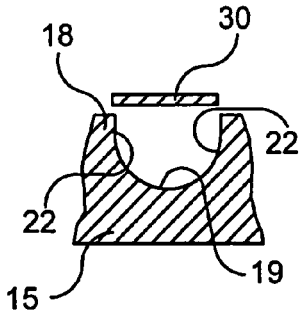
FIG. 3A is a view similar to FIG. 3 of an alternative pixel.
Figure 3B:
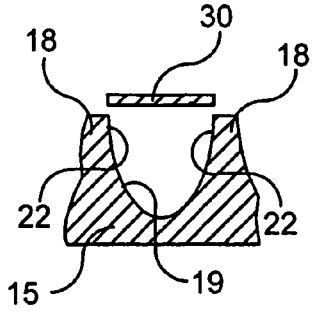
FIG. 3B is a view similar to FIG. 3 of a further alternative pixel.

To enhance the brightness of the display, for a given light output from the LEDs, or other light source, it is desirable to maximize the proportion of the emitted light that is deliverable to the viewer. Accordingly, the inner surfaces of light channels 20 are preferably all reflective, and preferably all have maximum available reflectivity. For example, the inner surfaces may be highly polished or coated with aluminum or other highly reflective surfacing material. Light channels 20 may have other cross-sectional configurations. For example the corners between divider wall surfaces 22 and substrate upper surface 24 may be chamfered or rounded. By employing a channel cross-sectional configuration having a circular curvature, as shown in FIG. 3A or a parabolic curvature, as shown in FIG. 3B, some measure of focusing of the reflected light, in a direction perpendicular to the channel plate 15, may be obtained. However, it is preferred that the cross-sectional size and shape of light channels 20 correspond with the retracted size and shape of flap 30 so that a retracted flap will prevent light from the respective LED channel 16 from passing to other, possibly still-closing shutters further along the channel.

For flexible embodiments of display panel 10, it is preferred to enable flexibility, or curvature, about an axis, or axes, parallel to light channels 20, the axis or axes preferably being located on the viewer side of display panel 10 so that channel plate 15 curves or flexes around shutter array 12. Preferably light channels 20 are constructed to be substantially rigid along their lengths to minimize the probability that residual geometric deformations will interfere with their optical performance. In such flexible embodiments, channel plate 15 preferably has a thickness and other structural characteristics such as to accommodate the designed flexibility of shutter array 12. Optionally, scoring, or separation lines can be provided on the back of channel plate 15 (remotely from the viewer), to permit dimensional expansion of the channel plate 15 to accommodate flexing or curving around shutter array 12.

LED Assemblies 16

Modern LED technology provides bright light devices capable, when used in suitable combinations, of emitting across the full color spectrum at a cost which is relatively low for the functionality provided. However, the cost is such that were one or more LEDs to be used for every pixel in a display, the display would be economically uncompetitive with existing technologies. The present invention provides a cost effective solution to the problem of employing LEDs in a video display by scanning the light from a single row of LED's into a two dimensional image. The discoveries and techniques of the invention can also be used with other light sources, as described herein and as will be apparent, or will become apparent to those skilled in the art.

Preferred, present day LEDs, known to applicant, emit a divergent light beam, so that highly reflective surfaces are desirable in the light guides to enhance the brightness of the display. Such divergence is helpful in permitting the individual LEDs 28 of each LED assembly 16 to be aligned one behind the other, as shown in both FIG. 1 and FIG. 2, with respect to the direction of an emergent light ray, without significant loss of light intensity from the posterior blue or green LEDs 28.

Various mechanical systems can be employed to fix LEDs 28 in proper position, for example on channel plate 15, to be optically effective. For example, LEDs 28 may be mounted in groups on a flexible strip 29, e.g by adhesive bonding, and the flexible strip 29 may be snapped, face down, into channels 20. Suitably bonded LED die are available from Micropac Industries.

Future availability of economical LEDs, or other equivalent light sources, that have the capability of emitting a highly collimated light beam, may avoid or reduce the need for the channel surfaces to be reflective. However, individual such hypothetical light sources may need to be physically aligned at each channel so that their emitted beams are not blocked by an adjacent light source. Employment of small, transparent light emitting elements, pursuant to the invention can alleviate such geometric light blocking problems.

In the exemplary embodiment shown in the drawing employing presently available LED technology, each light channel 20 receives light from at least one LED assembly 16 located at one end of the channel. Preferably, the other end of the channel 20 is closed by a reflective wall to return residual light along the channel. If desired, instead of closing the other ends of channels 20 with a wall, a second LED assembly 16 may be provided at each end of one or more light channels 20. If this modification is employed, the LED assemblies at each end of a given light channel 20 are preferably synchronized to operate simultaneously with one another. Such an arrangement is more expensive but helps compensate for attenuation of the light beams emitted by the LED assemblies 16, as the light beams travel along the light channel. Preferably also such a light channel 20 has a reflective divider wall at the mid-point of its length, in which case simultaneous operation of the LED assemblies at each end of the channel may not be necessary. Transverse division of channel 20 in this manner is preferably also accompanied by a reorientation through 180°, of a corresponding portion, e.g. half, of the shutter display covering the other ends of channels 20 so that all shutter elements 30 can have their outer surfaces 32 face toward the other end of channel 20 to receive light from the second LED assembly 16.

Present day LEDs are particularly well adapted to serve as light source elements of the inventive displays by virtue of their abilities to be rapidly switched with short startup and sharp cutoff phases between emissions, to sustain prolonged duty cycles with a high proportion of "on" duties, the consistent luminosity characteristics of their emitted light, their small physical form, their low cost and their reliability. It will however be appreciated by those skilled in the art that other light sources may be used that have if the meet the requirements of the invention, and can provide suitable light output and switchability for a given display. In particular, it will be appreciated that for monochrome displays and for larger outdoor displays, such as traffic signs and lower resolution displays such as stadium displays, some of the requirements may be less rigorous.

Figure 4:
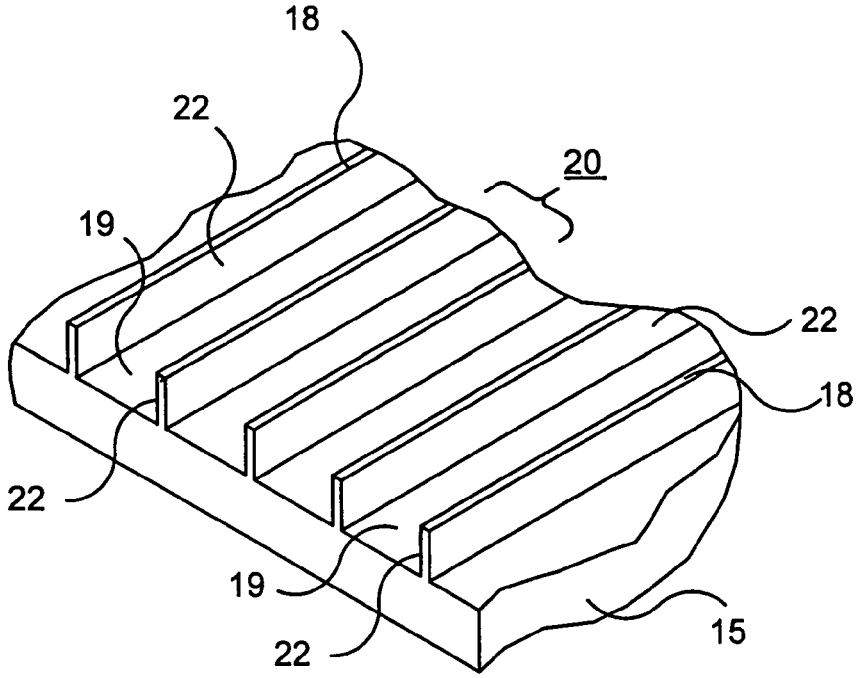
FIG. 4 is a perspective view of a portion of a ribbed substrate component of the display shown in FIGS. 1 and 2.
Figure 5:
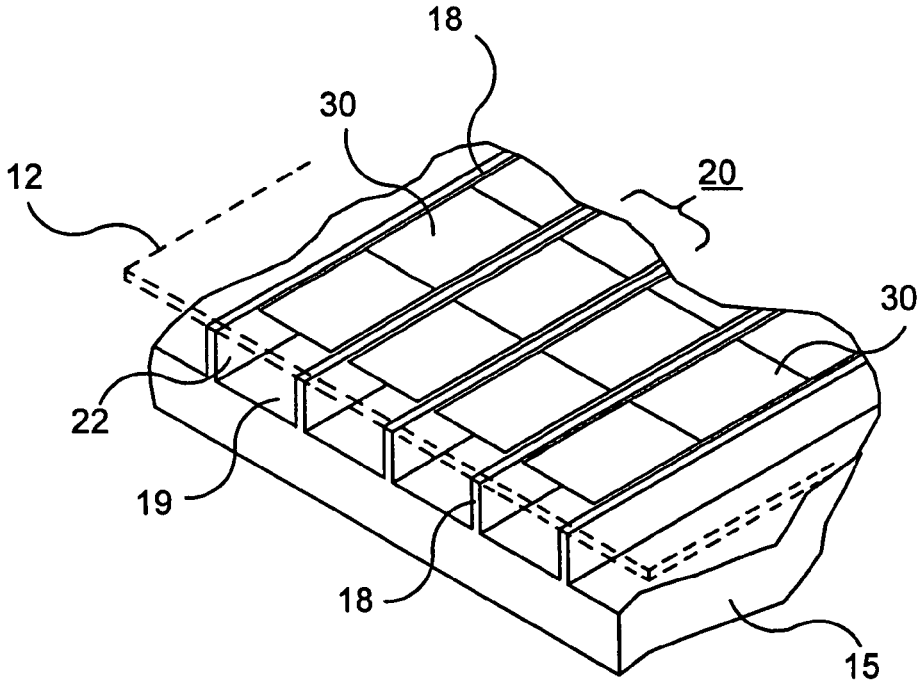
FIG. 5 is a perspective view of the substrate component of FIG. 4, in combination with a shutter matrix array.
Figure 6:
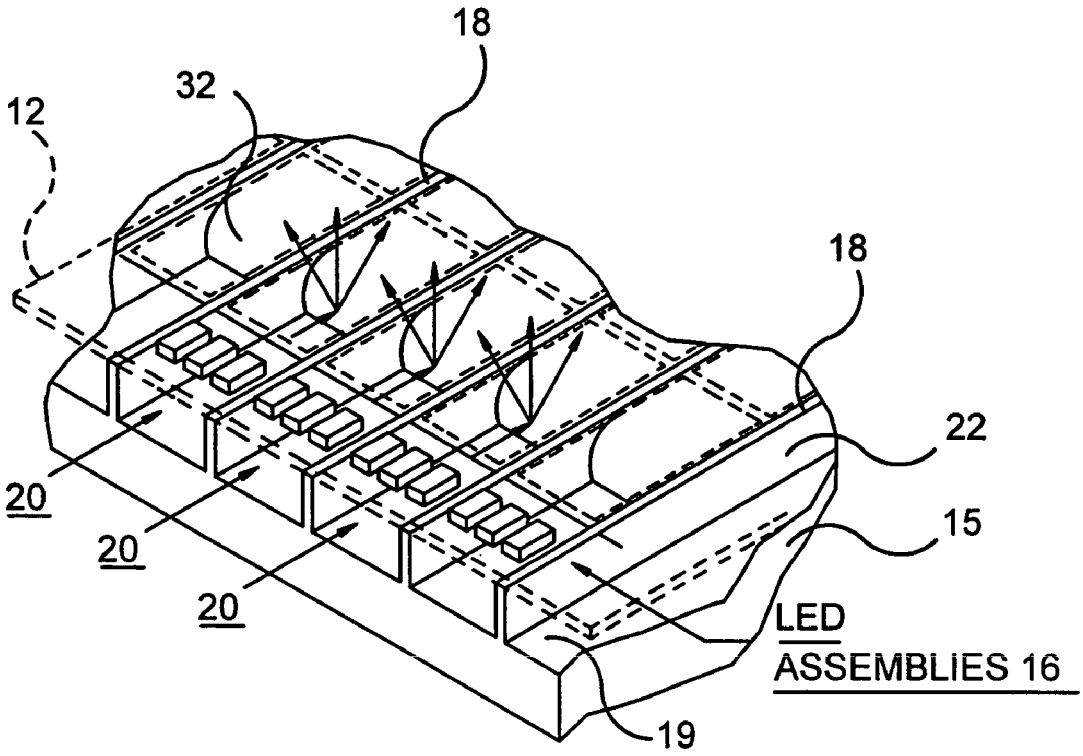
FIG. 6 is a perspective view of a modified embodiment of electropolymeric video display according to the invention employing the components shown in FIGS. 4 and 5.

As shown in FIGS. 1 and 2, individual LEDs in each assembly 16 are arranged one behind the other so that they are aligned in the longitudinal direction of each channel 20. Alternatively, as shown in the embodiment of FIGS. 4-6 they may be arranged side-by-side to emit their divergent, approximately conical beams in parallel directions along a respective light channel 20. In such case, light channels 20 may be somewhat wider than they are for an in-line array of the LEDs, the better to accommodate the side-by-side light beams. The drive signals can provide compensation for attenuation of the light beam as it travels along each light channel 20, by increasing the intensity or duration of light pulses for more distant pixels.

As shown in the drawings, multiple LEDs shine along each light channel 20. It can be understood that this arrangement permits the display to have a wide range of appearances, and in particular to operate as a full-color video display. However, it can also be understood that a single LED can also employed for a monochrome display, for example a yellow, red, green or white LED. Preferably a dark background, for example as described hereinbelow, is also employed in such a monochrome display. Similarly, a banded or other desired appearance may be provided, by using LEDs of different hues in different rows, but with a single LED at each light channel 20. Special effects may thus be created in a low cost display.

The individual LEDs within a given LED assembly 16 preferably have optical emission characteristics, that differ one from another. Depending upon the visual effects desired in the display, and the specifications of available LEDs, an LED assembly 16 can comprise any desired combination of optical characteristics including, in particular, but without limitation, combinations of different hue and intensity characteristics. For example, a particularly preferred combination comprises a red, a green and a blue LED, "RGB", selected to emit light beams with hues and intensities that can be combined to provide white light and to provide a full spectrum of colors. However, if desired, other color combinations may be used, e.g. for special effects.

Within the limitations of the LED specifications, the intensity, for example, may be varied, or selected, electronically, by differentially varying a drive signal characteristic, typically, the voltage, to an individual LED.

As illustrated in FIGS. 1 and 2, the three colors red, "R", green, "G" and blue, "B" are arranged in the sequence B, G, R, reading outwardly from the periphery of the display area. While other sequences, for example R, G, B, or G, B, R can be employed, it is preferred to arrange the LEDs in sequence according to their maximum intensities, with the least intense closest to the shutter array 12, or first in the line of sight from the channel. Thus, the sequence B, G, R is preferred with presently available LEDs because blue is the least efficient and because the blue and green LEDs are nearly clear and can pass light created by an LED behind them.

A more expensive alternative to triplets of RGB LEDs is to add yellow and employ a quartet of LEDs in each LED assembly 16, RGBY. This arrangement can enhance the brightness of yellow and white, improve white balance and provide a more brilliant picture for given RGB intensities. Alternatively, a fourth LED might be blue, to compensate for the generally lower intensity of presently available blue LEDs. Other selections of LEDs can be employed, as will be apparent to those skilled in the art, or as may become apparent as the art develops. For example, for a greater color gamut, six LEDs may be employed, comprising warm and cool hues of each of red, green and blue.

In another alternative embodiment, providing a high intensity display, multiple arrays of RGB LEDs, or other suitable light sources, are arranged to illuminate each channel 20. To this end, the light sources need not be positioned beside and shine directly into a channel 20, but may be piped or channeled to channel 20 from other locations through secondary light guides or light pipes, for example, fiber optic guides. The term "secondary" is used to distinguish light guides that bring light to the channels 20 from channels 20 themselves which are also described as light guides and light pipes herein, and which may be considered, by contrast, as primary light guides, pipes or channels. The light from an array of multiple light sources, e.g. an array comprising a red, a green and a blue LED may be collected and conveyed to a channel 20 by a single fiber optic. Alternatively, each color could employ a separate fiber optic. In a further alternative, multiple such arrays supply a single channel. Usually similar light sources will be employed at each channel. However, different sources may be employed, if desired. One exemplary way of piping light from an LED array to a channel 20 is illustrated in FIGS. 16-21, which are described hereinbelow.

Given the desirability of small pixel size, for enhanced resolution, light sources used without fiber optic piping may benefit from being geometrically oriented, e.g. tilted, to facilitate channel illumination. For example, cubic LEDs 28 of dimension greater than the channel width, for example 0.25 mm (10 mil) versus 0.18 mm (7 mil), that emit light laterally, can be tilted to direct light into the channel.

Alternative light sources to LEDs, for example, packaged RGB sources, laser sources, piped sources, fiber optic sources, and so on, as mentioned above, should preferably be selected according to relevant characteristics of the display, for example, the number and size of the pixels, and the like. Such other light sources should be electronically switchable at adequate rates for pixel operation, bright enough to illuminate the far end of channel 20 and small enough to shine along channel 20, or else be suitable for their light output to be piped to channel 20.

When closed, shutters 14 present their reflective surfaces to the viewer, providing a background appearance. Accordingly, the reflectivity of outer surface 32 and the hues and intensities of LEDs 28, or other light sources, should be chosen to provide suitable contrast with that background.

Illustrated schematically, in FIG. 2 only, is a light source mounting comprising a flexible strip 29 which provides one exemplary way of supporting LED assemblies 16 in channels 20. As shown, flexible strip 29 extends across the ends of channels 20 that project beyond shutter array 12, resting on channel walls 18, and support LED assemblies 16 depending downwardly into channels 20. Preferably, flexible strip 29 provides an optical seal with adjacent structure to prevent stray environmental light entering channels 20 and contaminating the visual appearance of the display. Preferably, flexible strip 29 extends the full width of the shutter array area alongside row R1 and has sufficient flexibility to conform to any configuration the display is capable of taking. In a rigid display, a rigid strip 29 can be employed. It will be understood that flexible strip 29 can comprise multiple cooperative sections, if desired. Any suitable means can be provided to secure flexible strip 29 to the display, for example, adapting it to be a snap fit in channel plate 15, latches, adhesive and the like. Flexible strip 29 preferably also provides an electrical supply path to LED assemblies 16 comprising suitable terminations, conductors such as traces, and the like. If desired chips, boards or other components providing drive circuitry or other support services for the display may also be mounted on flexible strip 29.

Conductors for the rows (not shown) may extend along the left- or right-hand edge of the display, as shown in FIG. 1, adjacent the shutter array and connect with the metallization of shutters 14, to be further described hereinbelow, which metallization extends along each row.

In a preferred embodiment, flexible strip 29 comprises a flexible circuit member material, for example polyimide, provided with conductive traces and mounting pads for LEDs 28. The geometry is preferably such that the spacing of LEDs 28 allows one LED assembly 16 to fit directly in the end portion of each channel 20. This is only one of various possible configurations for mounting and coupling the LEDs that may be employed. Other configurations are described hereinbelow and still further alternatives will be apparent, or will become apparent to those skilled in the art.

Electropolymeric Shutters

Referring to FIG. 2, shutters 14 are preferably electropolymeric shutters, each comprising a movable shutter element in the form of a flap 30. Each flap 30 has a reflective outer surface 32, provided, for example, by an aluminum or other mirror coating. Movement of individual flaps 30 between a closed position and an open position is effected by application or removal of an electrical voltage. Preferably, the shutters are mechanically biased into either the closed or the open position and an applied voltage is effective to oppose that bias, whereby removal of the applied voltage causes a shutter element 30 to adopt one or the other of the closed or open positions, as determined by the bias.

In the preferred embodiment shown in FIGS. 1 and 2, flaps 30 can be metallized polymer film, prestressed into a coiled or partially coiled or curved shape, which corresponds with the open shutter configuration shown in broken lines in FIG. 2, and can be moved by electrostatic forces into a flat, uncurved closed shutter configuration, as shown in full lines, by application of a control voltage.

Intermediate voltages can be applied to obtain intermediate flap positions, or shorter shutter opening intervals, to provide desired optical effects, for example, gradations of hue or intensity.

It will be understood that the broken line position is a schematic representation and the actual open configuration of flap 30 may depart substantially from the illustrated broken line position. An idealized configuration would be for open flap 30 to extend approximately diagonally across the vertical rectangle defined by the pixel and the channel, preferably at about 45°. In practice only some approximation to such a configuration will be achievable. The geometry of the pixel and channel 20 and the nature and magnitude of the prestressing induced in flaps 30 is preferably selected to provide a high quality reflection from the opened flap 30. Flaps 30 should open as much of the pixel area as possible, close to light as much of the channel cross-section as possible and reflect as much light to the viewer as possible.

Thus, in the closed state flap 30 lies in a horizontal position, as shown in FIG. 1, or in the plane of the paper, as shown in FIG. 2, while in the open state it depends downwardly, beneath the plane of the paper, to intercept a light beam traveling in the underlying channel 20. The intercepted light beam is reflected upwardly from display panel 10 toward a viewer.

Each individual shutter 14 defines a picture element, or pixel 24 of the displayed image whose appearance can be individually varied with respect to the appearance of other pixels, under electronic control. A pixel 24 can be regarded as an individual cell comprising a tubular volume disposed perpendicularly to channel plate 15 and extending above and beneath a single shutter 14. The image is composed by suitable electronically effected variation of the appearances of the pixels constituting the display area. The construction and operation of an electropolymeric embodiment of shutters 14 will be described in more detail below.

While electrostatically operated plastic film coils, as described herein provide a particularly preferred shuttering technology for employment in the invention, it is contemplated that other shuttering technologies may be employed. One such alternative shuttering technology employs electronically movable silicon mirrors which can be moved into and out of the light path along a channel 20 to deflect light from a light source at the end of the channel toward a viewer or viewing device. Suitable silicon mirroring technology will be apparent to those skilled in the art, in the light of this disclosure, for example from U.S. Pat. No. 6,075,639 (Kino et al.); U.S. Pat. No. 5,629,790 (Neukermans et al.); and U.S. Pat. No. 6,081,304 (Kuriyama et al.), the disclosures of which patents are hereby incorporated herein by reference thereto.

Shutter Array Layering

Shutter array 12 is preferably formed from a contiguous polymeric sheet or piece of sheeting which may be drawn from continuous stock in a continuous feed manufacturing process. Pixel-sized flaps 30 can be cut from the sheet, on three sides, and the sheet is then bonded to ribs 26 over the entire area of channel plate 15, the uncut fourth side of each flap providing an anchor and enabling the shutter to function as a flap.

Referring now to FIG. 7 read in conjunction with FIG. 2, a characteristic portion of shutter array 12 is shown in section, illustrating the underlying structure of shutter array 12. Flaps 30 are actuated electrostatically for which purpose they are constituted as movable electrodes that respond to electronic control pulses by moving toward or away from one side of a layer of dielectric material, on the other side of which is a grounding electrode. These functions are provided by layers of polymeric material, some of which are coated, as will now be described.

As shown, shutter array 12 has three layers, all of which can be made of flexible plastic, or polymeric sheet material, two of which are coated with electrically conductive materials to provide control electrodes for actuating the electropolymeric shutters. An outermost support layer 34 comprises a transparent plastic sheet, for example of polyethylene terephthalate, (also referenced "PET" herein) covered on its inner surface with a thin, transparent, conductive layer 36 which can, for example, be formed of indium tin oxide (also referenced "ITO" herein).

Middle, dielectric layer 38 comprises an insulating layer of non-polar material with suitable dielectric properties, which preferably also can be used in continuous web manufacturing processes. One such material is polypropylene. Others will be known to those skilled in the art.

An inner, shutter layer 40 provides the active functional elements of the shutter array, movable flaps 30. Flaps 30 are flexible to be able to conform to a light-deflecting configuration and have a reflective surface 32 to deflect light toward a viewer in that deformed configuration. Shutter layer 40 includes a conductive electrode surface which may preferably be reflective surface 32.

In an exemplary embodiment, shutter layer 40 comprises a 1 to 2 micron thick sheet of polyethylene naphthalate (also referenced "PEN" herein) coated on its outer surface 32 with a thin layer of aluminum or other conductive, reflective material. Rows of flaps 30 are cut out from the metallized PEN sheet leaving narrow strips 42 of material, along the top of each row, one such strip 42 being shown in FIG. 1. Shutter layer 40 is attached to dielectric layer 38 by adhesive along strips 42.

An advantage of the invention is that flaps 30 do not have to be individually actuated, requiring independent and separate application of a voltage across the shutter between its fixed and movable electrodes, and requiring the complexity of a multiplexed drive signal, with the difficult timing constraints of needing a separate pulse for every shutter in the frame within the refresh interval. For this purpose, the shutters can be individually actuated by employing half-select drive circuitry wherein the fixed electrodes are electrically interconnected in rows and the movable electrodes, (e.g. metallized flaps or shutters) are interconnected in columns, or vice versa. By delegating addressability of the pixels within the column to the LED assemblies 16, pursuant to the present invention, the addressing and switching requirements of shutter array 12 can be simplified, so that flaps 30 of each row R1-RN can be switched in unison. The conductor configuration needed for row-by-row switching is relatively simple.

The fixed electrode can be, and preferably is, a common ground plane extending substantially uniformly across every pixel, for example conductive, ITO layer 36. Flaps 30 are then electrically interconnected in rows. Such interconnection can be achieved by employing a conductive material for the lines of adhesive 42, or via metallization of outer surface 32. The metallization of outer surface 32 should have bands of separation between the rows to isolate the rows electrically which banding can be achieved either by initially applying aluminum to PET film in bands, or more preferably, since metallized PET film is commercially available, by subsequently removing strips of metallization between the rows, for example by laser etching. Row terminations 44 (FIG. 1) can be used to bring current individually to each row R1-RN.

Control Circuitry

Electronic control circuitry connected to the display, and described in more detail below in connection with FIG. 12, comprises an LED drive module and a shutter drive module. Operation of the LEDs is synchronized with shutter opening, by the drive circuitry. A data signal, for example a computer video signal, television picture signal, video text signal, video game signal, display advertising signal, or the like, is input to the control circuitry and is interpreted by the control circuitry to provide suitable drive signals for the hardware that will create the intended visual display when applied to LED assemblies 16 and shutters 14.

The light output of the LEDs can be controlled in two ways, by the amplitude of the current through the LED, and by the pulse width. Preferably, two intensity controls are provided, one control corresponding to the intensity of the video signal, and the other to compensate for light intensity losses as the output beam travels along light channels 20. The latter control is varied according to the vertical position of the shutter row being illuminated, greater compensation being provided for the topmost row, furthest from the LEDs.

Optionally, the drive current amplitude can be reduced as the image is scanned from the top to the bottom of the display, while the brightness of each pixel, as called for by the image data, is determined independently by the pulse width. As the scan approaches the line of LED assemblies 16, across the bottom of the display, the current, and therefore the power into the display is reduced.

Operation

In operation, a biasing voltage is applied to all the shutters 14 in shutter array 12, to hold shutter elements 30 closed against polypropylene dielectric layer 38. Each shutter 14 blocks off a portion of its underlying light channel 20, preventing light from the respective LED assembly 16 associated with the light channel 20 from emerging through that particular pixel to the viewer. This is the default shutter position, in which the pixel appearance is that of outer surface 32 of shutter element 30, a reflective appearance in preferred embodiments. With all shutters 14 closed, display panel 10 has a continuous mirror-like appearance, reflecting ambient light.

In this mode, the spring tension in the prestressed, coiled shutter elements 30, cut from PEN polymer shutter layer 40 is counteracted by the attractive capacitive force induced by application of the biasing voltage between the fixed electrode provided by conductive ITO layer 36 and the conductive aluminum outer surface 32 of shutter elements 30. A sufficient biasing voltage will hold flaps 30 closed against the polypropylene dielectric layer 38 and suitable pulses can then be applied to one row of shutter array 12, at a time, to cause selected, or more preferably all, the flaps 30 in that row to open.

During the time that the flaps 30 in a given row R4 are open, an appropriate current is applied to each LED assembly 16, with the desired luminance to provide a light output from the LED assembly 16 having the desired image appearance for the pixel defined by the column which contains the particular LED assembly 16 and the row R4 that is open at that time.

The display can be operated one row at a time with the data signals for that row, e.g. row R4, applied to all of the LED drivers simultaneously. The electro-polymeric devices, shutters 14, will open one row R4 at a time, in synchronism with the image data signal that is being applied to the LED's on the columns. Gray shades, or tints, can be determined by the amplitude of current through the individual LEDs, or the pulse width. Color can be achieved by using a red, blue and green LED in each channel, and varying the relative output intensities of the LEDs to obtain a desired color. It is not necessary to separate the color channels to the pixel to generate full color.

The flaps 30 that are open in a given row R4 effectively prevent light from passing further along the light channel, beyond the last row R4 opened. Therefore, it is not necessary to be able to close flaps 30 within the row address time. Instead, it is preferred that the flaps 30 close before the beginning of the next frame, so that the time available to close the flaps 30 can be as much as the frame interval (the inverse of the refresh rate), which may for example be as much as 1/100 or 1/60 second. The last flaps 30 opened at the bottom of the display should close within the vertical retrace time. The cycle time, or frame interval, should preferably be less than 1/30 second, the approximate human visual persistence duration.

To illuminate a single pixel 24, the applied voltage is dropped below each pixel's threshold value, allowing the pixel's shutter 14 to open, so that shutter element 30 extends downwardly into a respective underlying channel 20. In synchronism with the opening of shutter 14, the respective LED assembly 16 that emits into that channel 20 is actuated, causing the LED assembly to emit a suitable combination of light hues and intensities to emit a light beam providing the desired pixel appearance. The emitted light beam travels along channel 20 to the opened shutter 14 and is reflected towards the viewer, giving the target shutter a different appearance from unopened shutters, which appearance is determined by the optical characteristics of the light beam output from the LED assembly and the reflectivity of shutter outer surface 32. Preferably, an opened shutter element 32 effectively closes light channel 20

To operate the whole display panel 10, rather than merely illuminating a single pixel, various pixel matrix activation and scanning methods can be employed, as will be understood by those skilled in the art. One particularly preferred method, but not the only method, of activating an orthogonal array or grid of pixels 24, such as the display panel 10, is to scan the pixel array one row at a time, beginning with the top row R4 (or $R_n$) and progressing row-by-row, downwardly, toward bottom row R1 adjacent LED assemblies 16. Advancing the shutter opening toward the LED assemblies 16, reduces the probability that an open or closing shutter 14 can block a light beam intended for another pixel located further from the LED array. To this end, it is also desirable that only one row of shutters be activated at a time.

Those shutters 14 in the opened row, e.g. row R4, of pixels 24 designated by the data signal to be activated, simultaneously receive an opening pulse. Shutters 14 at pixel addresses designated for background on that cycle remain closed. While row R1 of shutters 14 is open, each LED group 16 designated by the drive signal, is fired, generating a suitable light beam as specified in the signal. The characteristics of the light beam are determined by the data signal and control circuitry which vary the outputs of the LEDs in each LED group 16, according to the visual appearance required of each opened pixel to make a proper contribution to the displayed image.

When the bottom row R1 is reached, the process is repeated, starting again at the top row, R4 or RN, with a frequency determined by the desired refresh rate, for example, for a current video display, 60 or 100 Hz.

Thus, electronic control of the display is isolated into electrically independent, but synchronized domains. In the horizontal domain, the rows are switched, one row at a time, starting at the top of the display, at the opposite ends of light channels 20 from the LEDs, to drop the voltage at designated addresses, below the shutter threshold and allow the shutters to open In the vertical domain, operating in synchronism with the horizontal domain, the LEDs in LED assemblies 16 are electronically modulated with video data to provide a desired light pulse for each opened shutter. As each row of shutters opens, the opened shutter elements bend into their light channels, deflecting the light from the row of LED's across the bottom of the display, out of the appropriate pixels for viewing. Preferably, the open shutters in the row block light from passing further up the display, allowing time for the upper shutters to be closed slowly. Thus the rate of shutter opening and closing is determined by the frame rate, not the line address rate, enabling the row-addressing power to be low.

Optically, the LED's shine down channels 20 on the surface of channel plate 15, and in a synchronized manner, the light beams they generate are deflected by the shutter array to emerge normally to channel plate 15. The RGB light exiting channel plate 15 comprises the displayed image.

As the rows are scanned, the modulated light from the single row of LEDs assemblies 16 is reflected by the opened flaps 30 out of the display's front surface to create a two dimensional image. The light from each LED assembly 16, though divergent, is deflected off flap 30 as a relatively collimated or concentrated beam, after being constrained in channel 20 where it is transmitted by shallow angle reflections. Accordingly, if desired, outer support layer 34 or other desired surface can be treated to diffuse the emergent light into a more nearly lambertian distribution.

Manufacture

Various manufacturing methods can be employed to make the displays of the invention, as will be apparent to those skilled in the art. Preferred embodiments of the inventive displays are particularly well suited to mass production. With advantage, selected components, for example channel plate 15, shutter array 12 and the LED array, can be fabricated separately, and then assembled together.

Figure 8:
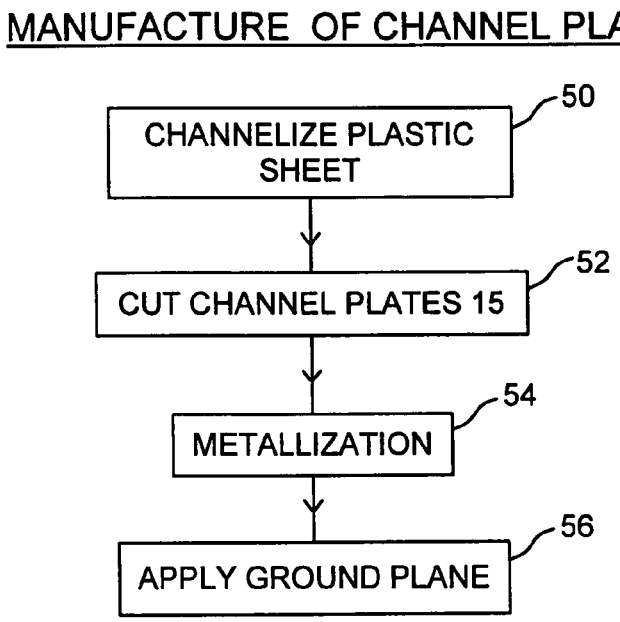
FIG. 8 is a block flow diagram of one embodiment of a novel method of manufacturing a channel plate which can be a component of the video displays of the invention.

Referring to FIG. 8, bottom substrate or channel plate 15, can be manufactured by molding, forming or etching a plastic sheet element to have channels defined by divider walls 18 running from the top to the bottom of the display area with a pitch equal to the pixel pitch, step 50. The height of divider walls 18 between channels is preferably approximately one half of the pixel pitch. For mass production, a continuous strip or web of channelized material can be formed, from which elements are cut to provide the channel plate, step 52. Preferably, in a further step, step 54, the surfaces of the channels are metallized or similarly treated to make the channels highly reflective. In an optional further step, step 56, a conductive ground plane is preferably applied to the bottom of channel plate 15 by roll-to-roll coating, prior to formation of the channels, but could be applied in other ways, or to the individual channel plate elements, if desired.

Various techniques useful in manufacturing suitable channel plate elements are known to those skilled in the art. For example channel plates for EGA or VGA, or comparable video displays, can be effected using technology proprietary to 3M Corp. (Minneapolis, Minn.), or suitable molds can be fabricated using mold-making techniques such as electrodischarge machining, photolithography or computer-controlled micromilling.

After mold making, the channel structure can be fabricated by thermoplastic molding or radiation curing and implemented in high volume web-based processing.

Shutter array 12 can be manufactured as a separate subassembly employing low cost, high volume, roll-to-roll, continuous web manufacturing techniques wherein one or more films of material are drawn from stock, typically a roll, by processing rollers.

Figure 9:
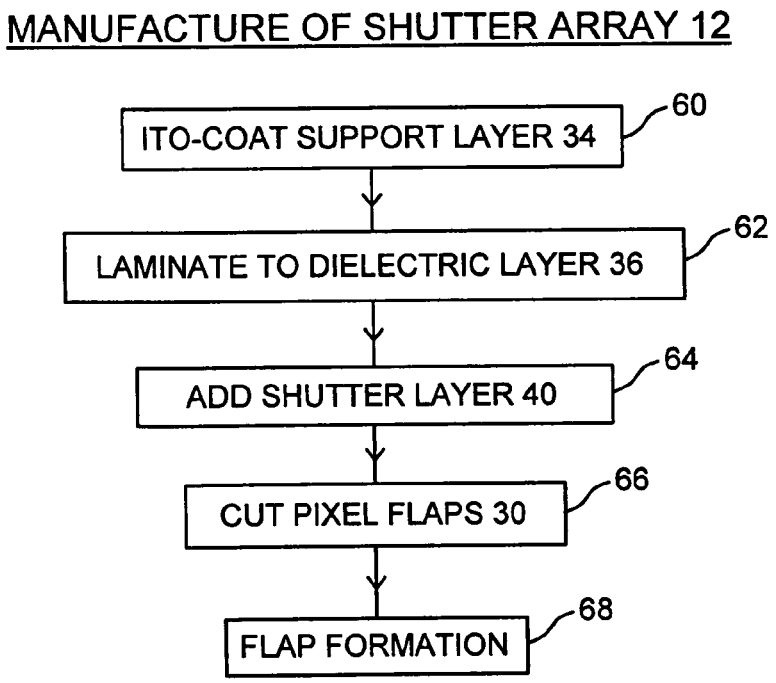
FIG. 9 is a block flow diagram of one embodiment of a novel method of manufacturing a shutter array which can be a component of the video displays of the invention.

Referring to FIG. 9, in a first step, step 60, of one embodiment of such a shutter array manufacturing method, according to the invention, a film of support layer 34 is coated on the underside with a continuous, unetched layer 36 of ITO, or other transparent conductive material, by deposition in a roll-to-roll process. In a second step, step 62, ITO-coated support layer 34, and dielectric layer 36 are laminated together, for example by heat and pressure, or by means of adhesive, along thin margins around the perimeter of the display area, outside the region coated with ITO.

In a third step 64, shutter layer 40 can be bonded to the polypropylene dielectric side of the laminated assembly of support layer 34 and dielectric layer 38, by applying a suitable adhesive pattern, for example by using a screen, to either layer 34 or 38. The adhesive pattern can comprise a series of narrow strips 42 along the top of each row of pixels, one strip 42 to each row R1-R4, or other suitable pattern. Ultrasonic bonding or laser welding or other suitable techniques may also be used.

After bonding, shutter layer 38 to the support layer-dielectric layer laminate, pixel-sized shutter flaps, constituting flaps 30, can be cut from aluminized PEN sheeting, by laser scoring or other effective means, step 66. Depth-controlled cutting is effected through the PEN sheeting layer to create a desired number of separate conductive rows of aluminum-coated flaps 30. Assuming flaps 30 are rectangular, three sides of each flap 30 are cut and released from the sheeting, leaving an uncut strip along the fourth side where the flap bonds to adhesive strip 42, anchoring the flap. The uncut strip of metallized PEN sheeting preferably extends continuously from one flap 30 to the next along adhesive strip 42 and thence along the whole row of shutters, providing a current path to the flaps 30.

If desired a marginal strip of PEN sheeting can be left between adjacent flaps 30, of width close to or slightly greater than the width of walls 18 in a row, to provide flaps 30 with clearance past walls 18 as they open into channels 20. Such marginal strips, if employed should contain a transverse cut or score at least through the metallization to electrically isolate one row from another. Alternatively, such marginal strips could be cut on all sides and removed, e.g. by suction.

The individual shutter flaps 30 are preferably cut on an X-Y table by means of a laser. The laser is adjusted to cut through the flap material and its aluminum coating without damaging the underlying dielectric layer 38. In the next step, step 68, a heat treatment causes the plastic flap material to shrink whereas the aluminum coating does not, prestressing flaps 30 to adopt a curled or rolled condition in the relaxed state. Alternatively, flap formation can be effected after assembly of shutter array 12 with channel plate 15 (see below). The degree of prestressing is selected to help flap 30 adopt a desired configuration in light channel 20, when flap 30 is open and relaxed, i.e. not subject to electrostatic forces.

The electrical conductors for the rows of flaps 30 comprise the metallization on the PEN material layer. The conductors should be of sufficient conductivity to allow charging and discharging of the pixel capacitance within the line address time. The ends of these conductors are conductively attached to traces on the substrate to permit connection to suitable driver circuitry.

The flap manufacturing process can be performed with good yield and reproducibility and suitable flaps 30 can exhibit lifetimes greater than $5\times10^8$ cycles with no signs of fatigue. Continuous 24×7 operation (24 hours a day, 7 days a week) of a display with a 100 Hz refresh rate implies about $2\times10^9$ cycles in one year.

Figure 10:
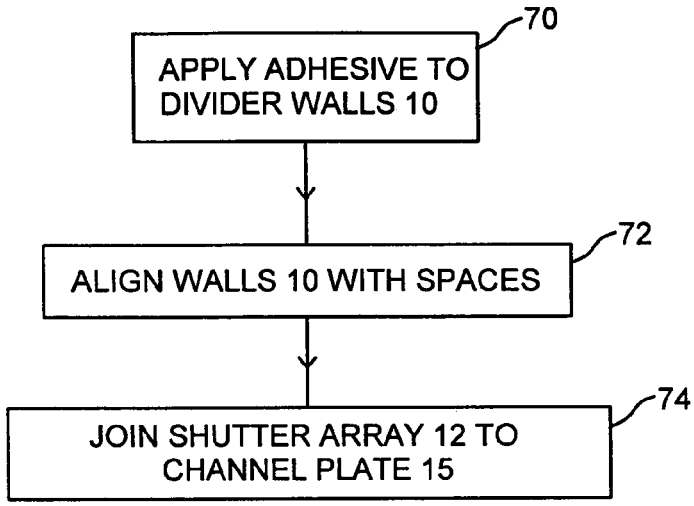
FIG. 10 is a block flow diagram of a method of assembling a channel plate such as that produced by the method shown in FIG. 8 with a shutter array such as that produced by the method shown in FIG. 9.

Referring to FIG. 10, the completed shutter array 12 can be assembled with channel plate 15 by applying an adhesive to the tops of divider walls 18, step 70, carefully aligning divider walls 18 with the spaces between the columns of shutter elements or pixel flaps 30, step 72, and joining the two components together, step 74. Alternatively, (or additionally) adhesive can be applied to the spaces between shutter elements 30, or other bonding techniques can be used.

Careful alignment of channel plate 15 with shutter array 12 is clearly important for proper functioning of the display. For VGA resolution satisfactory alignment is enhanced by maintaining a dimensional stability, or tolerance, of about 1 mil for both channel divider walls 18 and shutter elements 30. Such precise alignment is primarily desirable across the rows, as there is no significant alignment constraint along the columns. After assembly of the two components, the structure can be heated, shrinking the PEN material in relation to its aluminum coating, inducing stresses which cause the aluminum-coated PEN cutouts to curl away from overlying shutter array 12 into light channels 20 forming shutter flaps 30, unless heat shrinking was performed in step 68 (FIG. 9).

The LED array comprises sufficient LED assemblies 16 mounted along flexible strip 29 (for a flexible display) or other suitable support which strip assembly can be fabricated as a third component of the display. For example, individual LED chips arranged in groups, each group comprising an LED assembly 16, can be mounted on a flexible support strip, such as a polyimide flex circuit strip, by adhesive bonding or equivalent means. The flexible strip 29 assembly is furnished with suitable electrical terminations, and with such electrical circuitry as may be desired or convenient. The components on flexible strip 29 can be protected by encapsulation, if desired. Preferably, the LEDs are arranged on the strip in a pattern that will allow direct insertion into the channels of the substrate. Drive circuitry for the LEDs can be separately fabricated and connected with the flex circuitry, if desired, but is preferably integrated with the flex circuitry on a common support.

Video Signal Processing

Figure 11A:
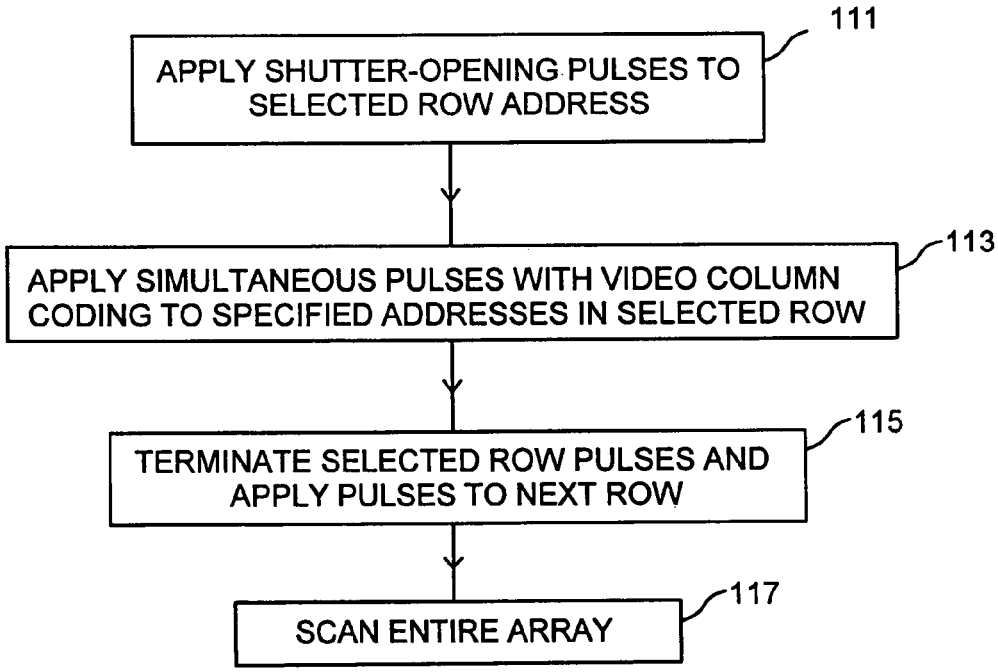
FIG. 11A is a block flow diagram of one embodiment of video drive method according to another aspect of the invention useful for driving the video display panel shown in FIGS. 1-7.
Figure 11:
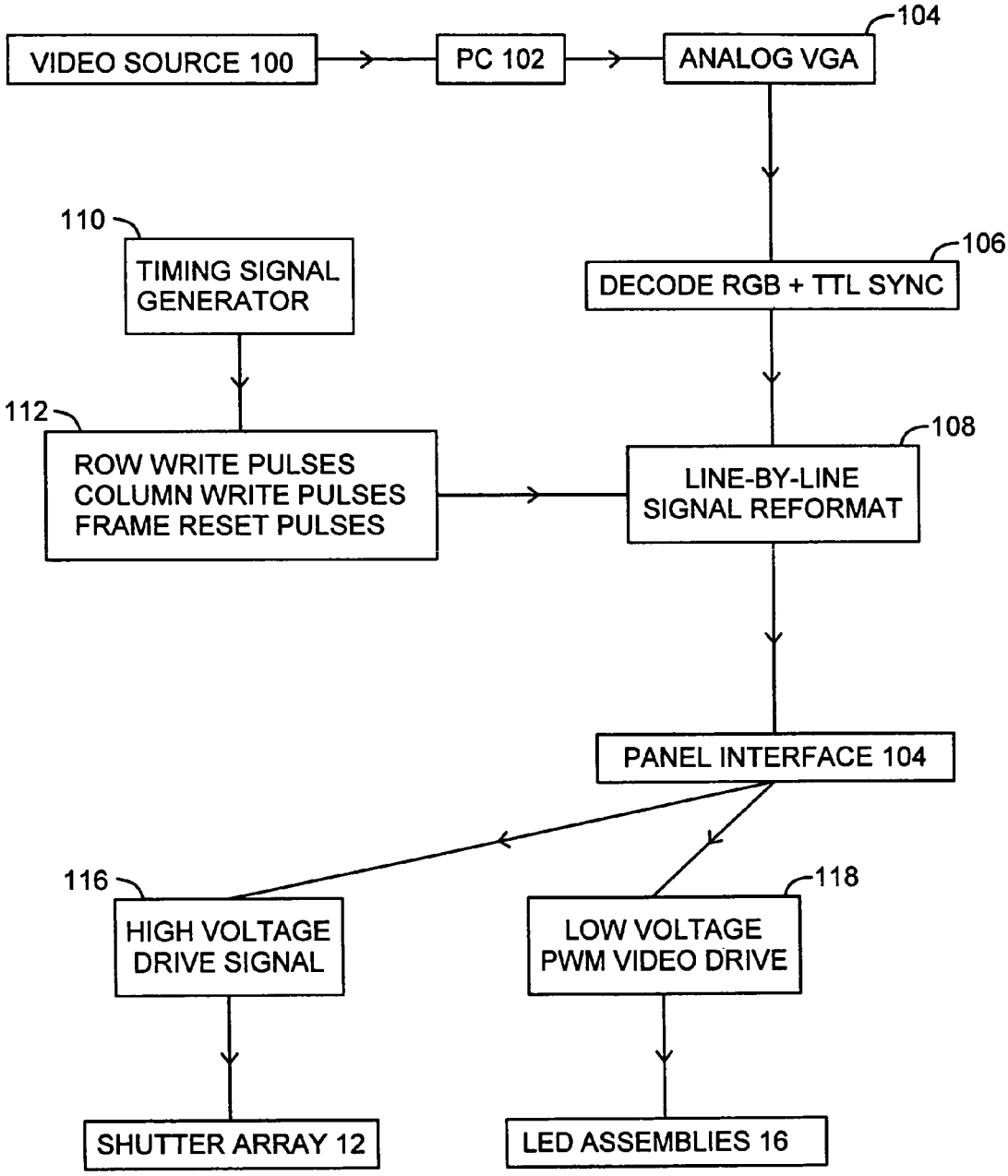
FIG. 11 is a block flow diagram of one embodiment of video signal processing method according to another aspect of the invention useful for the video display panel shown in FIGS. 1-7.

Referring to FIG. 11, the video display driver process illustrated by the block flow diagram shown employs, as input, a video signal source 100, which may be provided to video display panel 10 by any suitable analog or digital device. Analog video may be provided by a device such as a VCR, DVD player, a live cable or broadcast TV receiver or other video source meeting a suitable standard, for example, NTSC composite, PAL or an S-video standard.

To provide a digital drive signal for display panel 10, the analog video signal is processed by a suitable conversion device, shown symbolically as a personal computer ("PC") 102. Alternatively, the conversion device can comprise an integrated circuit chip, a printed circuit board or equivalent, incorporating appropriate signal generation and processing functionality, or both. The external analog video is processed within the PC by a video conversion card such, for example, as those made by Matrox Electronic Systems Ltd, (Quebec Canada) or N-Vidia, and is output in VGA format, analog VGA 104 in FIG. 11, from computer 102's monitor port.

The video signal characteristics such as color ratio, for example relative RGB values, can be adjusted, and variations in gamma correction can be set, by the video conversion card to optimize the picture quality. In this manner, flexibility can be achieved, enabling use of video display panel 10 to display a wide variety of imagery and information.

Alternatively, a digital signal may be supplied to PC 102 from a digital source such as a magnetic or optical data storage medium, e.g. disc or tape, an Internet connection, or a streaming digital feed such as satellite- or cable-distributed television.

Equivalent analog signal processing methods and apparatus capable of conditioning available analog video signals for display on display panel 10, will be known or apparent to those skilled in the art, without undue experimentation.

In a preferred embodiment of the invention, the analog VGA data signal 104 from the monitor port of PC 102 is digitized to provide a suitable drive signal for video panel 10. The necessary drive circuitry can be provided on circuit boards (not shown) connected to display panel 10 but positioned outside the viewing area.

In step 106, analog RGB and TTL sync information in signal 104 is decoded into a digital format suitable for driving a conventional display, for example, an LCD display. One suitable digital format comprises 8 bits each of red, green and blue pixel data along with a pixel clock-enabling rendition of 16.7 million colors. Many other possible formats are of course known.

In step 108 the digital data signal is reformatted before being applied to display panel 10. For this purpose, a timing signal 110 is provided from a timing signal generator 112. The timing signal is formatted according to the physical characteristics of display panel 10, such as number of rows and columns, and with due regard to the novel features of the inventive display panel 10. To this end, the timing signal can, for example, comprise, inter alia, row write pulses, column write pulses and reset pulses.

For the preferred embodiment shown in the drawings, the row pulses will be simple, constant amplitude pulses, timed to open each row R of shutters 14 of the display panel 10 in its due turn. The column pulses can be comparably timed with provision made for the addition of coding from the video signal to control the LED outputs according to the signal data. During reformatting in step 108, the video data signal is formatted according to timing signal 112, with hue and intensity information being included in the row pulses.

A panel interface module 114 (FIG. 12) receives the digital video and timing signals and generates a high voltage row drive signal 116 for operating shutter array 12 and a low voltage pulse width modulated (PWM) column drive video signal 118 for operating LED assemblies 16.

Row drive signal 116 provides the voltage for the shutter extend signal to each panel row in turn. In a half select-drive system, preferred for economy and simplicity, the drive signal can relax all flaps 30 simultaneously, through the broken line pendant position of FIG. 2, in the selected row R to reflect incident light generated by specified LEDs to the viewer. Clearly, all the flaps 30 at pixels to be illuminated in the selected row R, on a given cycle, are opened to deflect light to the viewer.

However, employing a full-select drive system with, for example, a column configuration of conductive layer 36, and suitable connections thereto whereby individual shutters 14 may be addressed by the drive circuitry, different background effects can be obtained, as desired, by opening, partially opening or leaving closed flaps 30 corresponding with non-illuminated pixels. For example, a light background can be provided by holding flaps 30 closed, which is to say extended, in the light-blocking position shown in FIG. 1 and a darker background can be obtained by fully opening the non-illuminated pixel flaps as suggested by the broken line position in FIG. 2. In that position, light incident on reflective surface 32 of flap 30 will largely be dispersed in the dark channel, rather than reflected back to the viewer. An intermediate position can provide intermediate darkening.

By simultaneously "firing" or pulsing all LED assemblies 16 having column addresses corresponding with pixels in the selected row R specified for illumination by the drive signal, the cycle time can be kept small and the illumination level of the display can be enhanced. Alternatively, a protocol which sequences through all active column addresses during the row cycle, firing the LED assembles 16 in turn for each illuminated column, may be easier to implement and provide a longer recovery period for the LEDs before they are pulsed again.

Depending upon the visual appearance of a particular embodiment of display, such controlled opening of non-illuminated flaps 30 may be used effectively to render black and gray areas of the displayed image.

Preferably, row drive signal 116 generates a pulse floating on top of a sustain, or bias, signal that selects the particular row being addressed in a sequential line-at-a-time fashion. Preferably, the row drivers are superimposed on a relatively high voltage sustain signal and logic level signals are input through opto-isolator circuits to avoid exposing the circuitry that generates and synchronizes these signals to the high voltage. The opto-isolator circuits can transmit the signals from the input to an amplifier or switch outputting a low voltage optical drive signal.

According to a preferred protocol, flaps 30, are opened sequentially in rows, advancing along the channels 20 beginning with the row of flaps 30 most distant from the LED assemblies 16, (at the top of the array as shown in FIG. 1) and finishing with the closest row, row R1 of flaps 30. This sequence avoids blocking of the illumination reaching a given flap by a previously opened flap closer to the light source. Each opened flap receives a light pulse from the respective LED assembly which is adjusted for the corresponding pixel according to the information in the drive signal for the pixel address. Thus, adjacent pixels along the channel may receive light pulses of quite different character. For example, to demarcate an image border of a red object on a white background, one pixel may receive one hundred percent red light and the adjacent pixel along the channel may receive the full intensity of red, green and blue light, or an adjusted mixture of all three colors that provides a balanced white. Column drive signal 118 preferably contains suitable pulses, or pulse patterns, for each pixel in the row that is activated during a particular row interval.

Referring to FIG. 11A, the preferred novel video drive method of the invention can be summarized in the steps shown. In step 111 shutter-opening pulses are applied to a selected row address, for example, the top row of the display, to open all the shutters in the row, e.g. flaps 30 into channel blocking positions. In step 113 pulses with video column coding are simultaneously applied to specified addresses in the selected row. The video column coding comprises the signal data for the pixel at a given column address in the selected row, e.g. data that will provide a light pulse comprising 50% red intensity and 50% green intensity at column A, row R1 to display as a yellow dot or rectangle in the bottom left-hand corner of the display.

In step 115, pulses to the selected-row of shutters are terminated and row opening pulses are applied to the next row of shutters 14. The shutters in the selected row need not, and indeed may not, close before the next row is pulsed. These steps are repeated, step 117, to scan through the entire array one row at a time.

Drive Electronics

Figure 12:
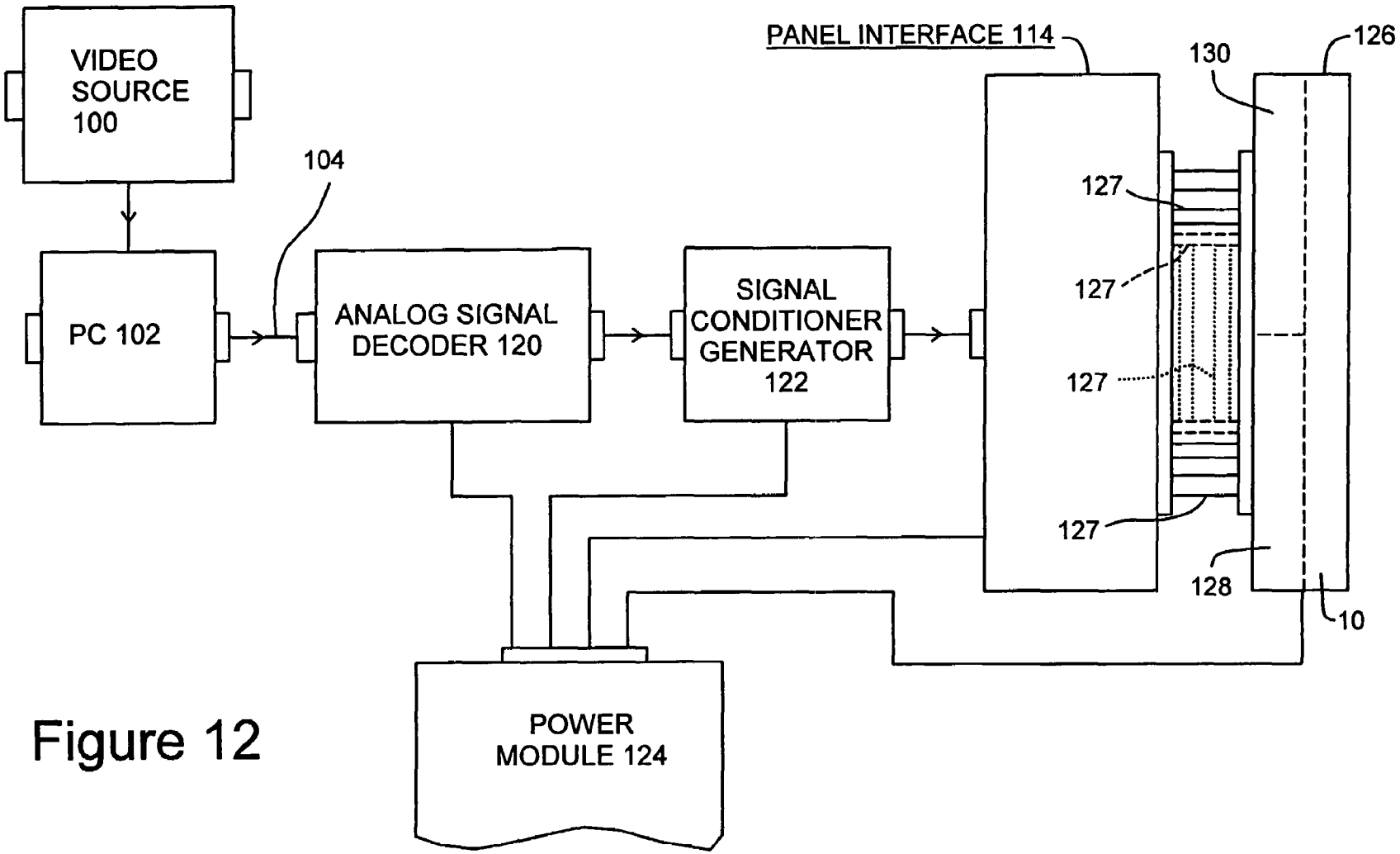
FIG. 12 is a schematic block diagram of one embodiment of video display drive electronics according to the invention.

Referring now to FIG. 12, the block diagram illustrates schematically one possible physical configuration of drive electronics that can be used to operate video display panel 10. As in FIG. 11, video source 100 is shown inputting a video signal to PC 102. Analog VGA signal 104 output from the VGA monitor port of PC 102 is input to an analog signal decoder 120 which performs step 106, decoding the RGB and TTL sync signal 104 and outputting a digital format signal to a signal conditioner generator 122. Signal decoder 120 can comprise a conventional digitizing controller card, such as is used for driving a conventional display, for example, an LCD display. The data formatting and timing generation functions of signal conditioner generator 122 can be accomplished with a suitably programmed integrated circuit module, such as a XILINX FPGA (trademark) integrated circuit solution available from Xilinx, Inc., San Jose Calif., and associated support circuitry.

Panel interface 114, which receives the formatted output from signal conditioner generator 122, comprises a low voltage pulse width modulator and suitable drivers for generating high voltage drive signal 116 which drivers can, if desired, be drivers known for driving electroluminescent panels for example model SUPERTEX 32 (trademark) line drivers available from Supertex, Inc, Sunnyvale, Calif.

Panel interface 114 has separate outputs connecting with shutter array 12 and LED assemblies 16 respectively via row and column connections 127. As shown in FIG. 12, panel interface 114 is spatially incorporated within its own housing behind a further housing 126 which contains video display 10.

The drive circuitry can be in two sections, namely a shutter array row drive circuit 128 and an LED array column drive circuit 130. Row drive circuit 128 is electrically connected, for example by way of metallic traces, to the metallization of anchor strips 42 whereby all the flaps 30 in a given row can be operated in synchronism, opening and closing simultaneously. Column drive circuit 130 is electrically connected, for example as described herein, to LED assemblies 16, or other light source.

Row driver 128 provides a time scan signal for the electropolymeric shutters while column driver 130 provides line-at-a-time modulation of the LED assemblies 16 according to the input signal characteristics. The only relationship that needs to be made between the two drive signals is to synchronize the scanning of the shutter rows with the modulation of the LED array.

LED driver circuit 130 can include shift registers and a line store for the video data, comparators with a ramp input and current drivers for each LED. The shift register can move a "1" (one) down the display panel to apply a pulse to each row of the shutter array. Other circuitry will be apparent to those skilled in the art.

In one preferred embodiment, the various drive electronics units are powered by a power module 124 which supplies several different outputs. One example of suitable outputs comprises a 200 to 280 volt sustain supply, a floating 60 volt row supply, a 60 volt ground referenced column supply, a 5 volt floating row logic supply, a 5 volt ground referenced supply and a low voltage LED supply. The highest voltages, 200-280 volts, drives the shutters 14. The 60 volt supply is used to produce signals superimposed on the drive voltages, and the 5 volt supply is used to operate both the LED's and the control logic that produces the drive timing signals.

In addition, a mechanism is provided to reverse the polarity of the sustain high voltage supply to periodically perform an overall negative reset to the panel to minimize charge storage phenomena. Physically, row driver 128 and column driver 130 can, if desired be combined into a single monolithic device, but the flexibility of separate devices, physically positionable along two perpendicular sides of a rectangular display is advantageous where compact form is desired. Alternatively, drivers 128 and 130 may be physically incorporated in other components such as video cards, special function cards, or the like.

One preferred hardware embodiment of LED driver comprises a constant current LED driver employing integrated circuits ("ICs"), for example as supplied by Texas Instruments. One such product useful in practicing preferred embodiments of the invention is a Texas Instruments model TLC5902 constant current driver which incorporates a shift register, data latch, constant current circuitry and 256 gray scale control using pulse width modulation. Each such driver can drive 16 individual LEDs. Each driver may, with advantage, be dedicated to a specific one of the three RGB hues, for example, the drivers can be configured as 40 red drivers, 40 green drivers and 40 blue drivers for a VGA display having 640 columns, with a red, a green and a blue LED in each column. Such a configuration permits tailoring of the individual red, green and blue currents in each column, as required to provide optimal white balance. Since LEDs are usually current controlled devices, it is preferred, according to the invention, to obtain good uniformity by using a constant current drive that is substantially insensitive to forward voltage variations in the LEDs in preference to a constant voltage drive.

The referenced Texas Instrument drivers can accept 8 bits of digital data to produce the 256 pulse width modulated gray scales just described. Since 256 levels of red, green and blue are addressable, 16.7 million colors can be produced by the panel. The drivers can be mounted on a panel interface board and interconnected to the LEDs mounted on a flexible strip formed of a suitable material, for example KAPTON (trademark E. I. du Pont De Nemours and Company Wilmington Del.) polyimide film, via a flex connector bonded with anisotropic adhesive. Alternatively, the driver die could be directly wire bonded to the back side of flexible strip 29 carrying the LEDs, forming an integrated LED module.

Some quantitative specifications of video displays of various sizes and resolutions that can be used in the practice of the invention are set forth in Table 1 below:

TABLE 1

| | | Examples of Display Specifications | | | | | |
|---|---|---|---|---|---|---|---|
| | | Ex. 1 | Ex. 2 | Ex. 3 | Ex. 4 | Ex. 5 | Ex. 6 |
| Typical Application | | Appliance, cell phone | Classroom, lecture hall | Notebook computer | HDTV | Traffic sign | Sports stadium |
| Resolution ($P_C \times P_H$) | | 20 × 60 | 480 × 640 | 768 × 1068 | 1200 × 1600 | 96 × 192 | 600 × 800 |
| No. of pixels in display | | 1200 | 307,200 | 820,224 | 1,920,000 | 18,432 | 480,000 |
| Sq. Pixel Dimension | in | 0.05 | 0.1 | 0.01 | 0.02 | 0.5 | 0.3 |
| | mm | 1.25 | 2.5 | 0.025 | 0.5 | 12.5 | 8 |
| Overall Dimensions | in | 1 × 3 | 48 × 64 | 7.7 × 10.7 | 20 × 30 | 48 × 96 | 180 × 240 |
| | cm | 2.5 × 7.5 | 120 × 160 | 19.2 × 21.4 | 50 × 75 | 120 × 240 | 450 × 600 |
| R Refresh rate | Hz | 30 | 30 | 60 | 60 | 30 | 30 |

Many other such specifications will be apparent to those skilled in the art.

Embodiments of the inventive displays can, if desired, have specifications directly comparable with those of conventional displays. However, since conventional displays employ side-by-side RGB subpixels, it may be expected that displays according to the invention employing LED assemblies 16 shining along light channels 20 will provide superior picture quality at the same resolution as conventional displays. Comparable viewing quality may be obtained at lower resolutions than conventional displays, for example at about one half the resolution, or even at the theoretical limit of one third of the resolution.

At the same resolutions as conventional displays, the inventive displays can provide superior color quality because the LED's can emit in three saturated primary colors to produce a full color gamut, the three primary colors being combined in the individual pixel increasing light throughput and providing better color perception.

An example of a preferred embodiment of the invention will now be described.

EXAMPLE 1

An exemplary full-color 15-inch VGA display (480 lines by 640 lines, about 53 lines per inch), according to the invention has a diagonal measurement of about 38 cm. (about 15 in.), a height of about 23 cm (about 9 in.) and a width of about 30 cm. (about 12 in.), implying a pixel size of about 0.45 mm (18 mil). The display is constructed as described above, with a shutter array 12 mounted on a channelized substrate or channel plate 15 and a line of LED assemblies 16 illuminating the light channels 20. The shutter array 12 comprises a common ITO fixed electrode film 36, a polypropylene dielectric film layer 38, and an orthogonal grid of rectangular shutter elements 30 cut from a metallized PEN film layer 40.

The LED assemblies comprise commercially available LED die, having an emitting area of about 0.25×0.25 mm (about 10 mil×10 mil), are employed emitting along each channel, giving an emitting area to pixel area ratio of about 1:3.24. Each LED assembly 16 comprises a combination of a red, a blue and a green LED to produce a color gamut comparable with conventional cathode ray tubes. Some suitable commercially available LEDs are: CREE (trademark) "Super Blue" LEDs having a light output of 43 cd/M2; NICHIA (trademark) NSPG500 green LEDs having a light output of 601 cd/M2; and ROHM (trademark) red LEDs having a light output of 6943 cd/M2.

The overall brightness and viewability of the display is determined by the total luminous output and is sensitive to luminance losses attributable to reflection along the light channels, off shutter elements 30 and to transmittance losses through the dielectric, the ITO coating and the outer cover.

To illuminate a white pixel, pursuant to the invention, the drive circuitry can be controlled to proportion the power applied to the three above-described LEDs to provide a desired appearance. A desirable white pixel can employ a greater luminous flux for red than for blue and a much greater luminous flux for green than blue. For example, the red flux may be from 1.5 to 5 times the blue, e.g. about 3 times and the green flux may be about 3 to about 10 times the blue flux, e.g. about 6 times.

One example of a suitable combination of energy levels that can be used is as follows: CREE blue: 27 mW; NICHIA green: 10 mW; and ROHM red: 0.25 mW, providing a total power of 37.25 mW resulting in a power consumption for a white pixel of 0.037 W. Other patterns of proportionate energization of the individual LEDs can be employed to provide a white pixel, as will be understood by those skilled in the art, or as may be determined by simple experimentation, wherein the relative power levels are varied to provide a desired white or other appearance.

Quantitative description of the overall brightness of display panel 10 requires knowledge of the attenuation, or energy losses of the light emitted from the LEDs as it travels to the viewer. The light beam output from the LED assemblies 16, positioned at the ends of light channels 20, becomes attenuated as the beam is reflected along the channel. Theoretical considerations suggest that a 23 cm. (9 inch) embodiment of light channel 20, with inner surfaces metallized for reflectivity, as described herein, may have a channel efficiency of about 19% at the pixel at the far end of the light channel 20, remote from the LEDs and about 95% at the pixel adjacent the respective LED assembly 16. Because of the attenuation along the channel, it is preferred that light guides 20 be oriented along the short axis of a rectangular display, which will usually be the vertical axis, generally, though not necessarily, designated as the columns.

The above figures give an average efficiency of 57% along the light channel display column. The luminous power output from the display panel is inversely proportional to the efficiency. A correction factor for the full column can be calculated as 19%/57% which equals ⅓. For all of the columns, the average power will be 640×0.037 W/3=7.9 W. 150 cd/M2 over a full display area of 0.75 square feet corresponds to 32 lumens. Therefore the average luminous efficacy, or light output per unit of electrical power, is about 32 lumens/7.9 W=4 Lm/W With regard to the brightness of the display, calculations based on the above described LEDs, with the assumed losses in the light channel suggest an achievable brightness as high as 430 cd/m2. Greater brightness will be achievable with improved LED capabilities.

EXAMPLE 2

Custom produced LED die are used to provide a display panel having 80 lines/inch, for a panel scaled to 50" diagonal.

Figure 13:
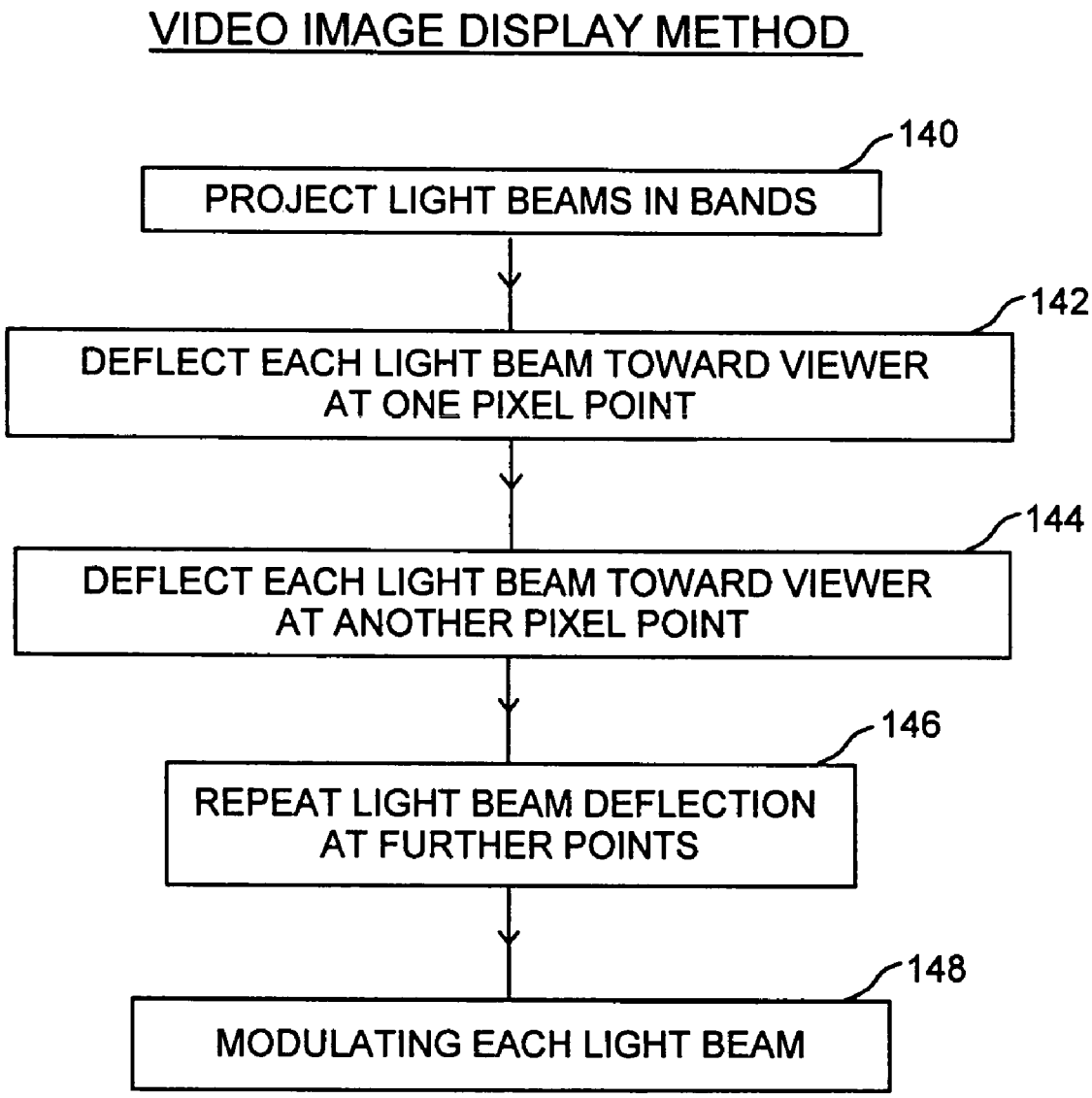
FIG. 13 is a schematic block diagram of one embodiment of a video image display method according to the invention.

Referring now to FIG. 13, the illustrated method of displaying a pixellated video image can be effected, by way of example, by employing a video display panel device or apparatus such as that described herein, or other such display devices or apparatus, as will be apparent to those skilled in the art.

The display method comprises projecting a number of optically modulatable light beams from an array of light sources in side-by-side parallel bands across the display area. The light beams are pulsed in accordance with a timing signal and the character of light in each pulse, e.g. with respect to chrominance and luminance, is preferably determined by a drive signal. The light sources can comprise groups of three primary colored sources addressing each band, for example LED assemblies 16, or other suitable light sources capable of being modulated to provide an image of desired quality. Each band may comprise a pixel column such as referenced A, B, C or D in FIG. 1.

Step 140 comprises generating a number of parallel light beams, locations corresponding with pixel addressed to be illuminated. The parallel beams may be considered as so many bands. Preferably, the beams are pulsed for the desired duration of illumination and individually modulated for specific pixel luminance, and optionally, chrominance.

Step 142 of the display method comprises selectively deflecting selected ones of the projected light beams toward the viewer at one of a series of points along the respective display band, the series of points corresponding with a line of pixels in the video image. Deflection of the light beams can be effected, for example, by reflection by a row $R_n$ of electropolymeric shutters 14, by torsionally loaded pivoting micromirrors or by other equivalent light deflection means. The beams selected for deflection are determined by a video drive signal. Deflection can be effected at points corresponding with pixels at different row addresses, provided that the deflection is properly synchronized with light source modulation, according to desired video image characteristics, and provided that the series of points in each light beam is cyclically addressed for deflection if so specified by the video signal. Steps 140 and 142 can be performed simultaneously, or step 142 can be performed before step 140, provided that the deflection means is in deflection mode when the light beam is generated.

Step 144 of the display method comprises selectively deflecting each projected light beam toward the viewer at another of the series of points along the respective display band. Such deflection is made in a manner similar to that in step 142. Preferably step 144 is effected at a point closer to the light source than the deflection point in step 142.

Step 146 comprises repeating step 144 until each beam has been deflected at all points in the series if required by the desired video image. In most cases, the series of points in each band will comprise a visually contiguous straight line traversing the display. It will be understood that each point in the straight line should be allotted a deflection time interval and that the light beam is deflected at, or deflection is attempted at, no more than one point at a time, in each band.

Step 148 comprises modulating each light beam at the respective light source while performing steps 144 and 146 so that each point in each series along each parallel band comprise a pixel of the video image. Each light beam is preferably modulated for chrominance, or hue, and luminance, or intensity, to provide a full-color video image. The method is preferably executed at rates suitable for displaying video images. The modulation of each light beam is timed, for example in pulses, which are preferably discrete, to coordinate with deflection steps 144 and 146 to provide the desired modulation for each pixel. If desired, the light beams can be pulsed to provide a short pause between deflections during which a deflecting member can be positioned for deflection, or a previously deflected member can retract.

Alternative Light Sources

Several alternative means of illuminating light channels 20, employing LEDs, are illustrated in FIGS. 14-19.

Referring to FIG. 14 a typical commercially available LED 28 has an approximately cuboid or cubic shape and comprises a transparent or translucent crystalline emitter 160 sandwiched between upper and lower electrodes 162, each of which extends substantially completely over one face of the emitter. Light is emitted from the four peripheral faces of emitter 160, being the vertical faces as oriented in FIG. 14.

As shown in FIG. 15, LEDs 28 of the type shown in FIG. 14 can be arranged in a corner-to-corner diamond pattern with their diagonals aligned in the direction of channel 20 to enhance collection of light from LEDs and transmission of the light along the channel. Channel 20 is preferably terminated with an internally reflective end wall 164, and may have an internally reflective cover, not shown. It will be appreciated, that all possible internal surfaces that can help convey emitter light along channels 20 are preferably reflective. As compared with the side-by-side squared up alignment shown in FIG. 1, the diamond pattern arrangement increases the direct radiation of light to the reflective channel surfaces, reducing absorption, albeit transmissive absorption, by the downstream LEDs.

FIGS. 16-18 show a packaged assembly 165 of three LED's mounted vertically within an elongated hemispherical housing 166. Within housing 166, a complementary group of three LED's 28 is disposed vertically, relative to a horizontal display panel 10. LEDs 28 are secured and grounded to an end wall 168 of housing 166 for support. A ground post 170 supports housing 166 in a desired position in relation to a channel 20 to be illuminated by the assembly 165. Individual conductors 169 provide current to LEDs 28. A fiber optic bundle 170 terminates at a cup 172 mounted approximately centrally in the dome-like curved surface of housing 166, facing LEDs 28. The other end (not shown) of fiber optic bundle 170 terminates adjacent a channel 20 to output light thereto. The internal surfaces of housing 166 and cup 172 are preferably highly reflective to direct light from LEDs 28 to fiber optic bundle 170 which receives light from any activated LEDs and outputs the light to one or more, preferably one, channel 20.

In contrast to longitudinally aligned LED assemblies 16, LED assemblies 165 are aligned transversely of the channel length. However, this arrangement is a matter of choice determined by spatial considerations rather than optical ones. Use of light pipe, such a fiber optic bundle 170 which can turn the light received from the LEDs 28 in any desired direction, provides completely flexibility in location and orientation of LED assemblies 165.

Figure 19:
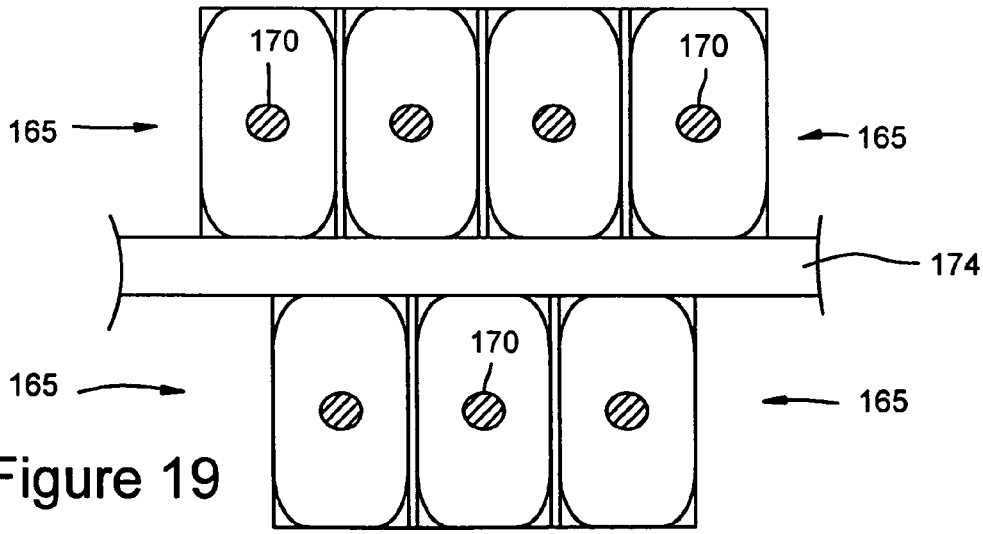
FIG. 19 is a view in the direction of a light channel of and two rows of packaged LED arrays.

FIG. 19 suggests one way in which LED assemblies 165 can be arranged alongside channels 20 in a manner permitting multiple LED assemblies 165 to serve a single channel. As shown the LED assemblies 165 are disposed in two staggered rows, one above and one below a circuit board or other support 174. If desired, further rows can be added, above and beneath the plane of the paper. Other arrangements will be apparent to those skilled in the art. At each channel 20, multiple fiber optic bundles 170 bringing light from a desired number of LED assemblies 165, for example, one, two, three or four, can be arranged in any suitable matrix transversely to the channel so that light from each is delivered along the channel.

Figure 20:
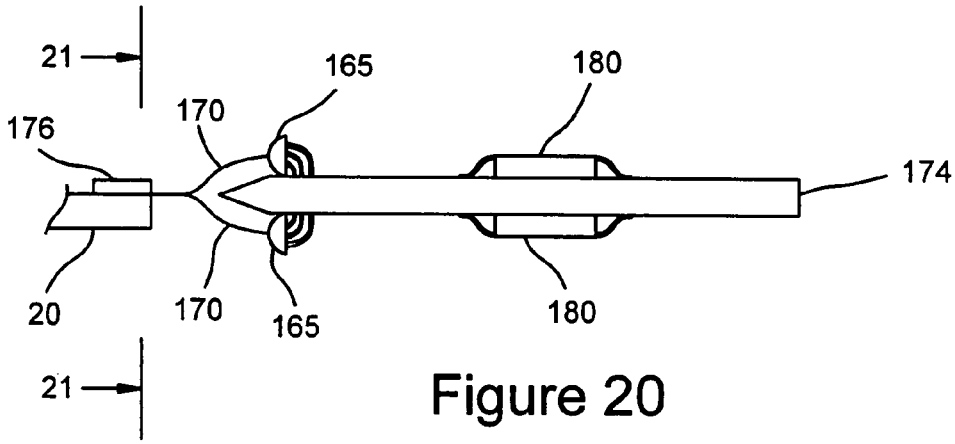
FIG. 20 is a schematic transverse view, perpendicular to the direction of a light channel of a printed circuit board and associated equipment that can be used in the video display panel of FIG. 1.
Figure 21:
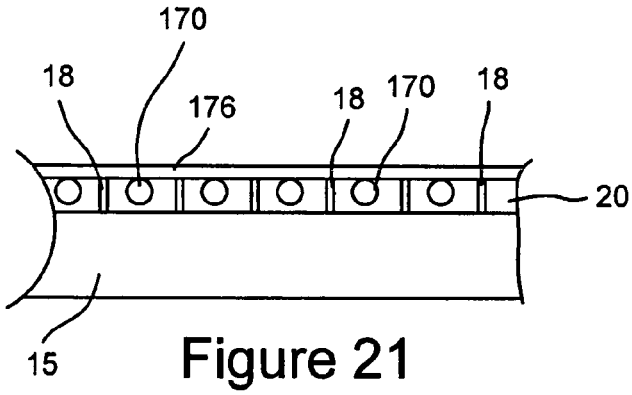
FIG. 21 is a schematic view to a larger scale on the line 21-21 of FIG. 20.

FIG. 20, which is a view transverse to that of FIG. 19, shows how LED assemblies 165 may be mounted at one side of a circuit board 174 which preferably extends the length of rows R1-RN of display 10 (FIG. 1), adjacent the end of each channel 20. A sturdy but flexible mounting strip 176, comparable with flexible strip 29 and similarly secured to channel plate 15, provides support and spacing. Fiber optic bundles 170 extending from LED assemblies 165 are mounted to the underside of mounting strip 176 between channels 20 in the upper surface of channel plate 15 to shine along channels 20 (FIG. 21). Necessary electronic components 180 such as integrated circuits and resistances are also supported on circuit board 174, away from LED assemblies 165 with conductor traces connecting to LED assemblies 165.

Silicon Mirror Shutters 14

Shutters 14 can comprise any suitable means that will controllably deflect light from a light source at one end of channel 20 toward the viewer and which is suitable for deploying in an array in a side-by-side configuration. As stated hereinabove, silicon or silicon nitride mirrors, and the like, are contemplated as being suitable, or being capable of being adapted to be suitable, for this purpose, as an alternative to electropolymeric shutters. One example of such a mirror is disclosed in U.S. Pat. No. 6,075,639 (Kino) the disclosure of which is hereby incorporated herein by reference thereto.

Figure 22:
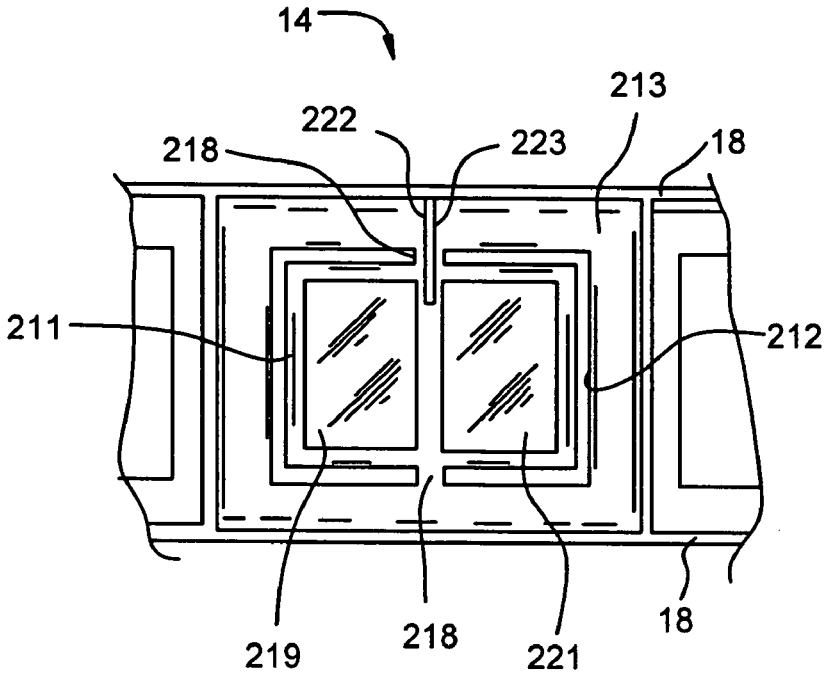
FIG. 22 is a schematic plan view of an alternative light shutter, in this case employing a silicon mirror.
Figure 23:
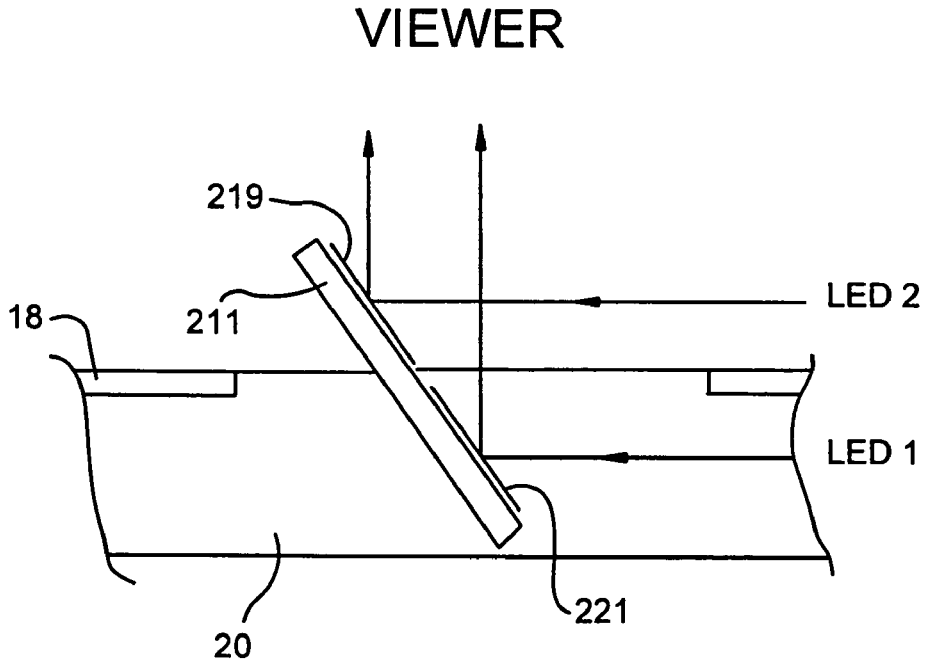
FIG. 23 is a schematic view on the line 23-23 of FIG. 22 showing a single silicon mirror, in this case in an open position.

Referring now to FIGS. 22-23, a silicon mirror embodiments of shutters 14 can be supported aligned in rows on channel walls 18 in much the same manner as flaps 30 with the difference that the silicon mirrors are mounted for rotation about an axis central to the long sides of the mirror. The mirror shown is similar to those disclosed in the aforementioned Kino et al. patent.

The silicon mirror employed has a silicon nitride mirror body 211 supported above a well 217 formed in the substrate 216 by integral torsion bars or hinges 218 formed or defined in the etching step. Reflecting electrodes 219 and 221 are carried by the mirror body, one on each side of the axis of rotation of the mirror body about the hinges 218. Leads 222 and 223 provide connections to electrodes 219 and 221. The substrate 216 may be conductive to form an electrode spaced from the electrodes 219 and 221 or a conductive film may be applied to the substrate. By applying voltages between the selected electrodes 219 or 221 and the common electrode, electrostatic forces are generated which cause the mirror to rotate about the hinges 218 between the closed shutter position shown in FIG. 22 and the open position shown in FIG. 23. Because mirror body 211 is pivoted about its mid-point, the left-hand side of the mirror is raised above the plane of the closed mirror and the top of wall 18. If desired, wall 18 can be extended upwardly, for example to the top of the open mirror. However such extension may be visually undesirable.

As shown in FIG. 23, the mirror is illuminated by two LED assemblies, referenced LED1 reflecting light to the viewer off the right-hand side of the mirror and an optional LED2 reflecting light to the viewer off the left-hand side of the mirror. LED1 shines along channel 20, beneath other, closed mirrors in the channel. Optional assembly LED2 projects its beam above the mirrors to supplement LED1, if desired. LED1 and LED2 operate in synchronism with substantially identical outputs, varying only in intensity, if desired.

Figure 24:
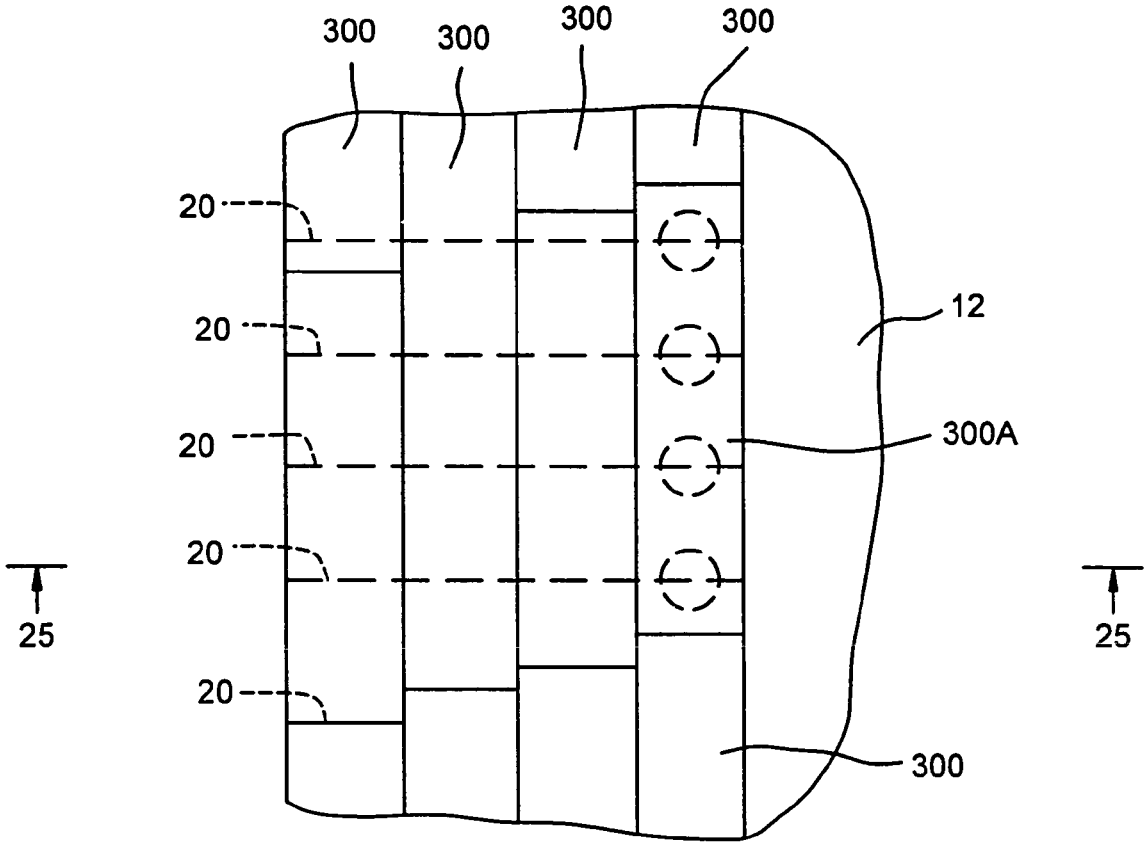
FIG. 24 is a plan view of a portion of another video display panel according to the invention employing a contiguous arrangement of block-like light holders to illuminate the display.
Figure 25:
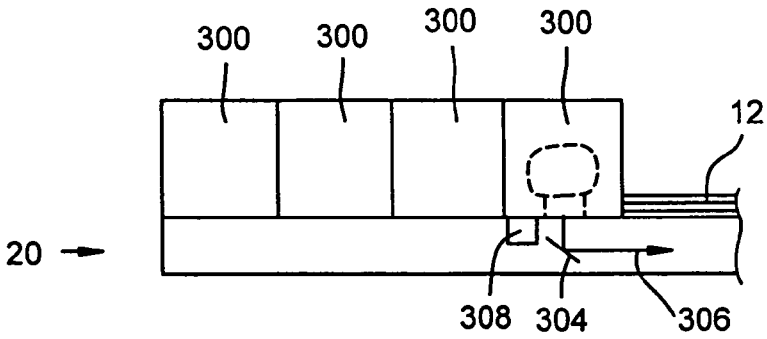
FIG. 25 is a view on the line 25-25 of FIG. 24, partly in section.

FIGS. 24-25 illustrate a video display panel which is generally similar to that shown in FIG. 1, with the difference that in place of LED assemblies 16 block-like banks of novel light holders 300 are employed. In this embodiment, multiple light beams, one for each channel, are generated in a direction transverse to the plane of video display 10 and perpendicular to channels 20 and reflected along channels 20 by individual mirrors disposed in the channels 20.

Light holder 300, described in more detail in connection with FIGS. 26-31, enables light generated by relatively bulky individual light sources such as light-emitting diodes or solid state lasers, to be guided to multiple side-by-side narrow channels 20. It will be appreciated that the construction of commercially available light sources, even small, highly collimated, or laser sources, includes significant mechanical structure around the light output which prevents multiple light sources being arranged with their light beams outputting in very close parallel adjacency as is desirable to illuminate channels 20 in video displays having small pixels. The present invention provides novel light holders 300 to solve this problem. Light holders 300 bend the light outputs from light sources contained within the holders through 90° or other desired angle and thus enable the light holders to be banked in staggered rows one row behind another alongside the optical entrances to channels 20, so that several parallel light beams output from one light holder 300 can be interdigitated between those of another similar light holder 300.

Offsetting the light sources from the light paths along the channels also facilitates the electrical servicing of the light sources, enabling the conductors to be introduced to the light sources in directions transverse to the plane of the display.

Referring again to FIGS. 24-25, the structure and operation of light holders 300 will be described by reference to one light holder labeled 300A with the understanding that the other light holders 300 can have similar or identical constructions. Light holder 300 has an elongated rectangular block configuration and comprises four light sources 302 arranged in a line along the light holder 300. As shown, light holders 300 are contiguously arranged end to end in four side-by-side columns extending across channels 20. The light holders 300 in each column are staggered by one channel width along the column with respect to the light holders 300 in adjacent columns.

Light sources 302 each emit a collimated beam of light of a desired color or white light in a direction perpendicular to the paper in FIG. 24 and down the page in FIG. 25, into an associated channel 20. As shown in FIG. 25, where the channel and mirror proportions are exaggerated, the light beam is reflected through a right angle by a mirror 304 disposed in the respective channel 20 to travel along the channel beneath shutter array 12 to be reflected toward a viewer by an open shutter 14 in the respective row. The path of the light beam is indicated by an arrow 306.

Figure 33:
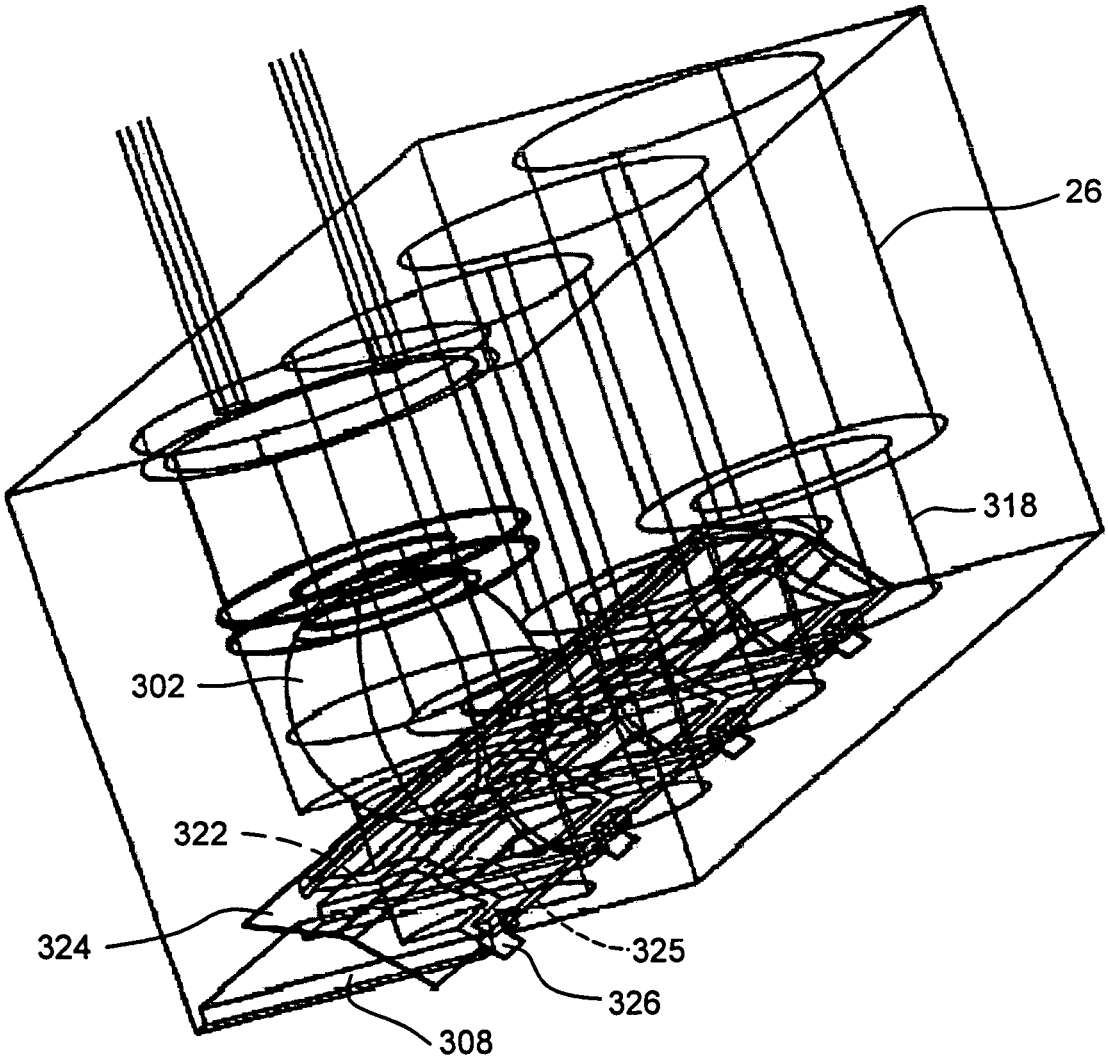
FIG. 33 is a perspective view of the light holder of illustrated in FIG. 26 assembled with one light source and mirrors.

Alternatively, light sources 302 can selectively emit one or more colors from a range of colors within the gamut of the source, for example each light source 302 may selectively emit one or more colors from individual red, green and blue light sources incorporated in each light source 302. Light sources 302 (one shown) and a mirror insert panel are assembled with block 310 to complete the light holder 300A, as shown in FIG. 33. Light sources 302 can be any suitable devices, for example small, compact, solid state lasers, e.g. vertical cavity side emitting lasers ("VCSEL") such as Honeywell model SV3644-001 6 volt visible red VCSELs.

Each light holder 300 extends across a number of channels 20 on which the light holder 300 may rest and be supported, if desired, which number is a multiple of the number of light sources 302 contained in the light holder. For example light holder 300 300A may extend across 16 channels 20, four times as many channels 20 as the light holder 300 has light sources 302 and output light to only four of these sixteen channels. The four illuminated channels are spaced apart at regular intervals, along the light holder 300, for example as every fourth channel, as shown by the broken lines in FIG. 24. Light holder 300 extends across the three intervening channels and occludes them to prevent stray light access.

It will be understood that the number of light sources in light holder 300 may be varied to any desired extent, for example in the range of from 2 to 10, e.g. 3, 4, 5 or 6. Similarly rather than every fourth channel, light holder 300A may couple with from two to ten channels, e.g. every other channel or every third, fifth, sixth or tenth channel, or the like. The number of columns of light holders 300 will usually correspond with the channel spacing between feet 308.

Each light holder 300 has four alignment feet 308 (only one shown) one for each respective channel 20. Each foot 308 projects downwardly into its associated channel 20 and is a precise dimensional match to the channel so as to be a close, or even tight fit within the inside walls of the channel to hold the light holder 300 in suitable alignment with the channels 20. None of the structure of light holder 300 protrudes into the optical path within any of the intervening channels. Thus, the intervening channels may be illuminated from light holder 300 in the adjacent columns. Staggering of the light holders 300 permits each intervening channel to be illuminated from one of the other three columns of light holders 300.

Referring to FIGS. 26-31, light holder 300A is substantially sculpted or otherwise formed from a longitudinal block 310 of a suitably machinable or moldable material such as an aluminum alloy or a high tensile strength rigid polymer. It will be understood that light holder 300A can be assembled from multiple components, if desired.

Figure 26:
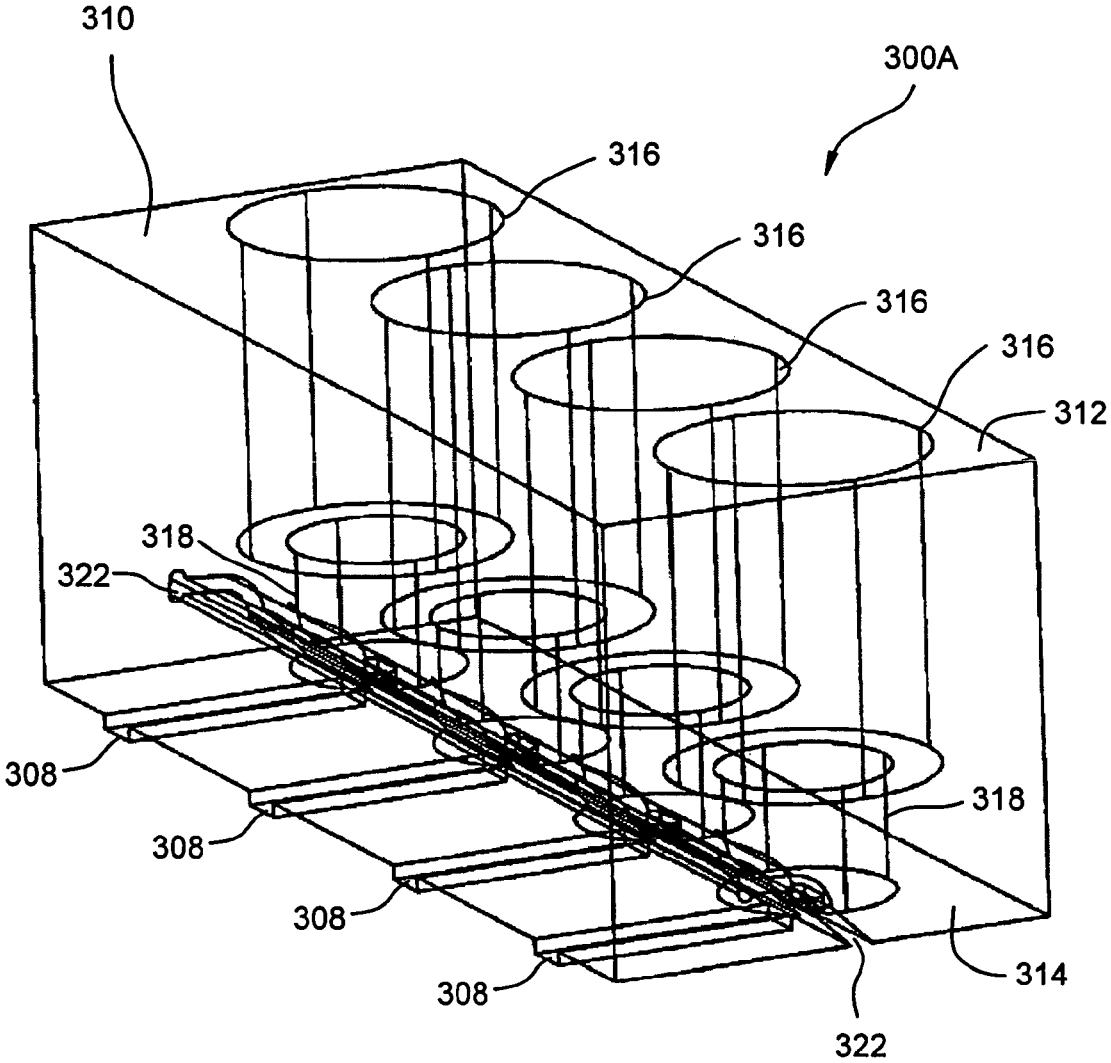
FIG. 26 is a perspective view of one of the light holders illustrated in FIG. 24.
Figure 27:
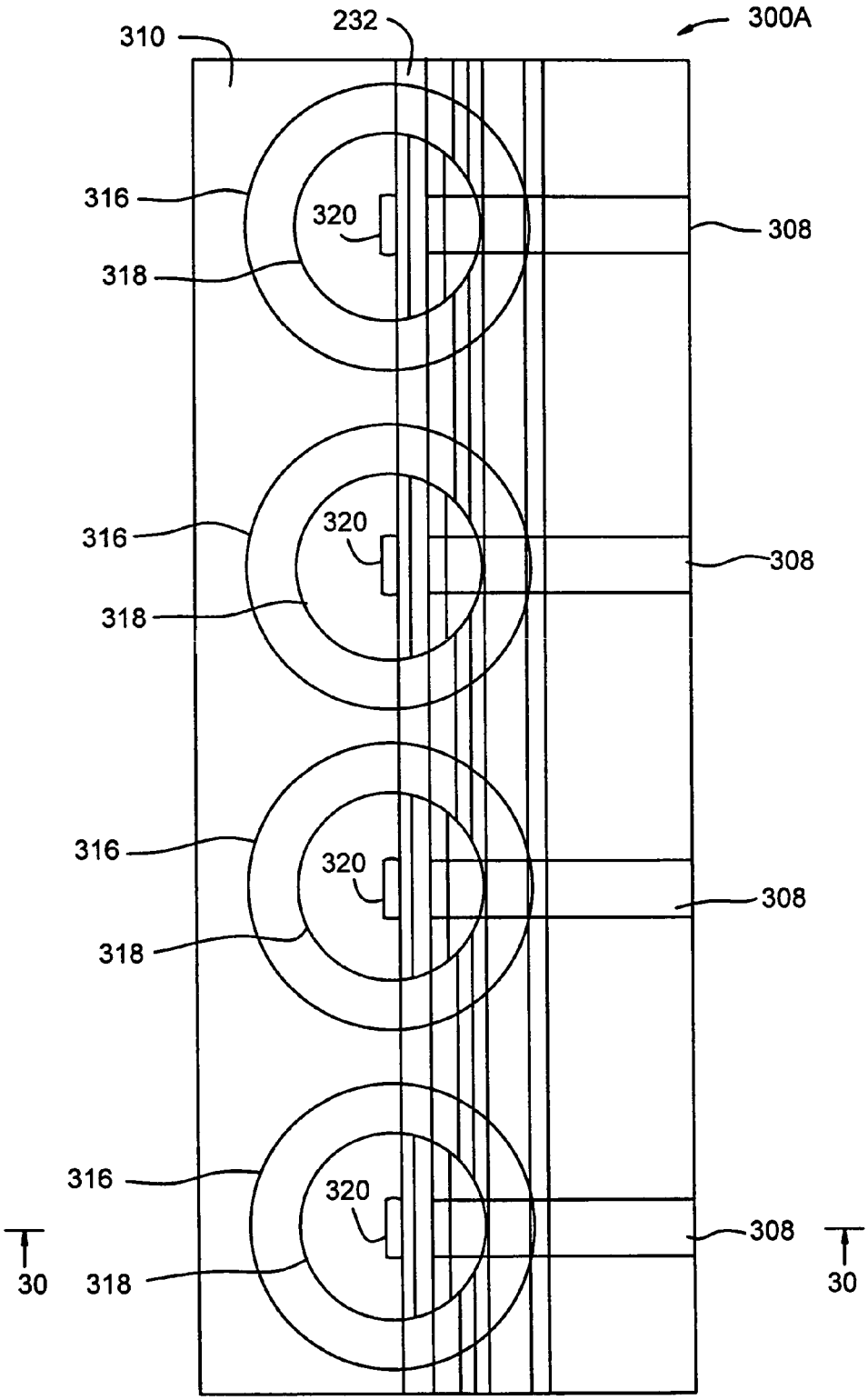
FIG. 27 is a bottom plan view of the light holder illustrated in FIG. 26.
Figure 28:
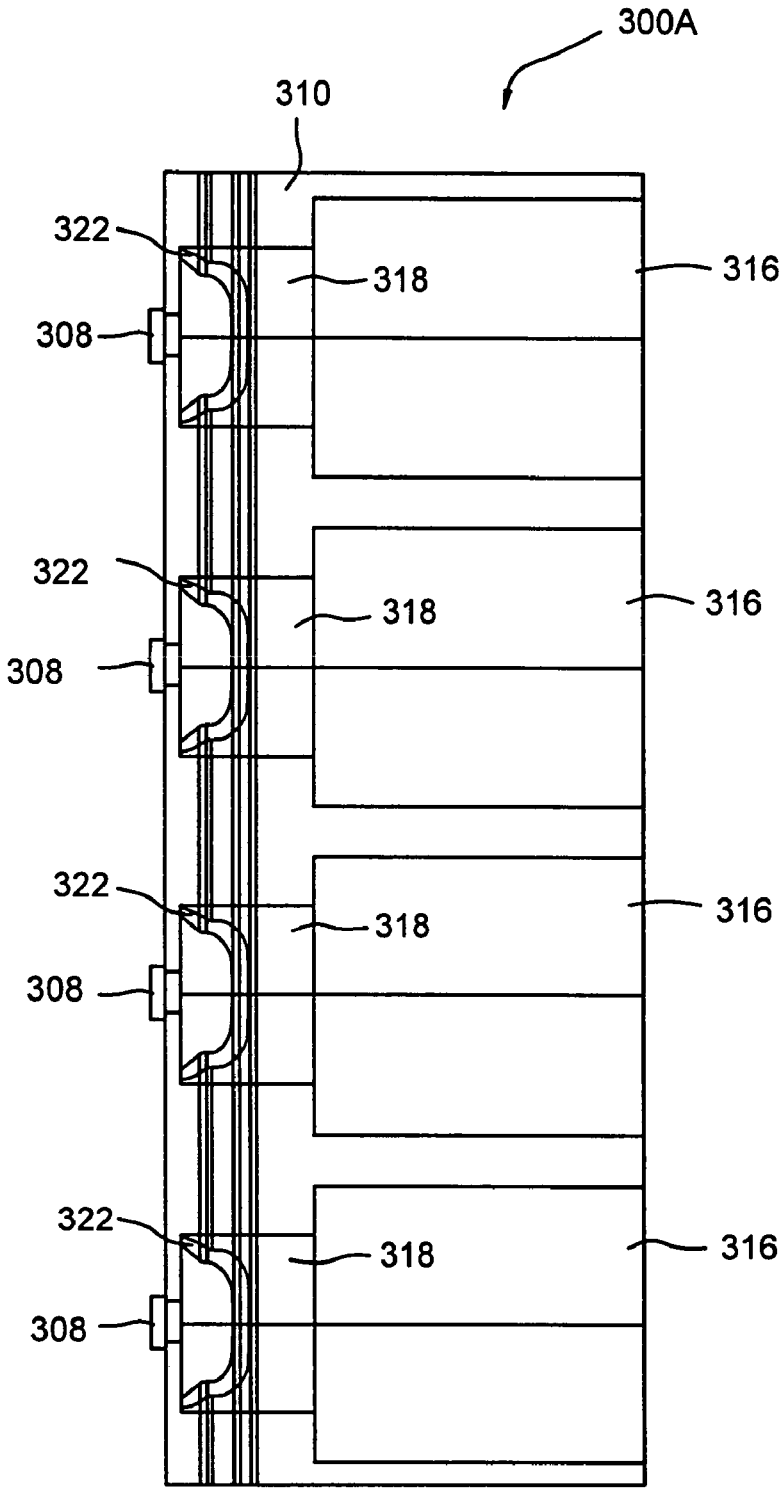
FIG. 28 is a right-hand elevational view of the light holder illustrated in FIG. 26.
Figure 29:
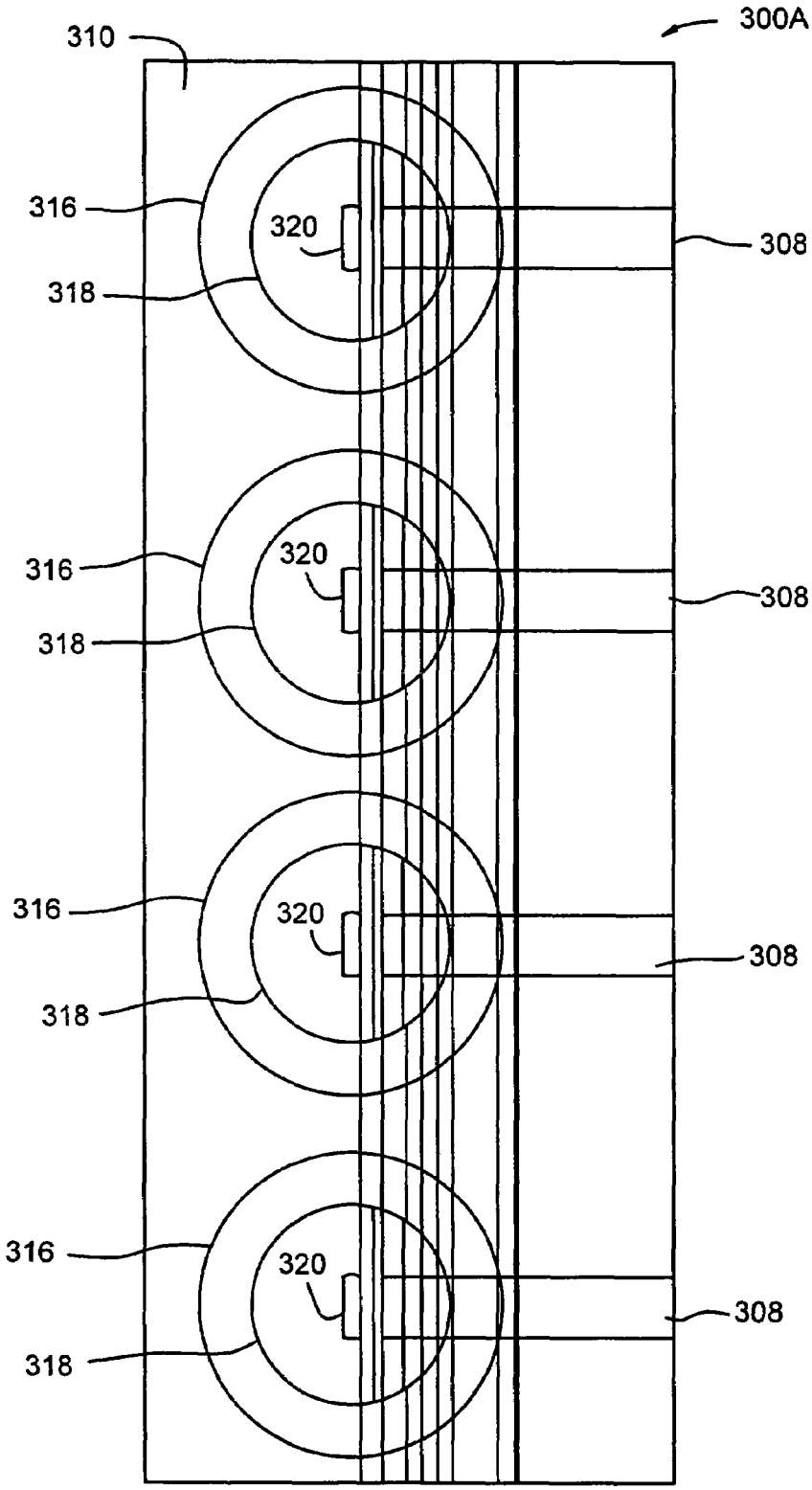
FIG. 29 is a top plan view of the light holder illustrated in FIG. 26.
Figure 30:
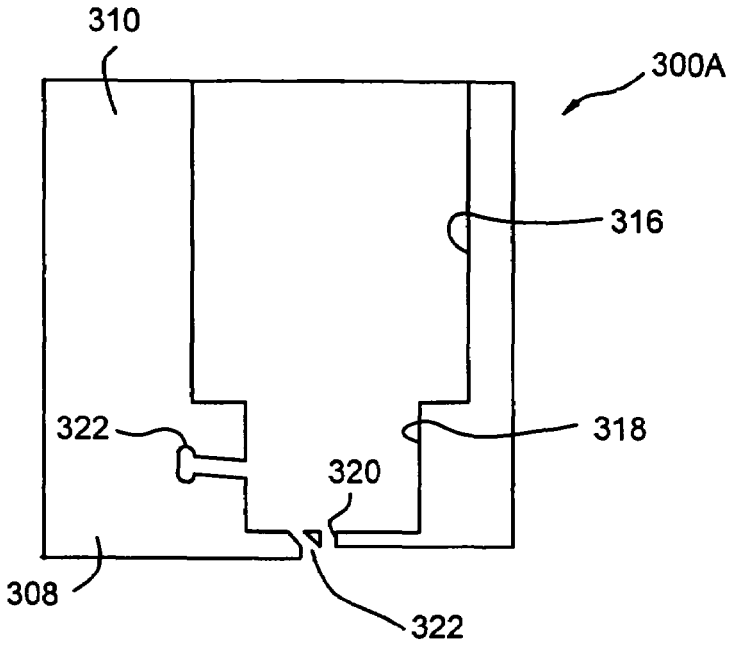
FIG. 30 is a sectional view on the line 30-30 of the light holder illustrated in FIG. 26.

The four lateral sides of light holder 300A, as it is shown in FIG. 26, and have no projections, to be a flush, optionally sliding fit with another similar light holder 300A against any one of the four sides. Conveniently top face 312 also planar. In addition, the bottom surface 314 is largely planar, save for the four longitudinal feet 308 and the four associated mirrors 304, which project downwardly from bottom face 314. Mirrors 304 are shown only in FIG. 33.

Four cylindrical pods 316 extend downwardly from upper face 312 and open into four smaller, concentric cylindrical counterbores 318. Pods 316 and counterbores 318 receive and accommodate the four light sources 302 which shine light downwardly, again referring to FIG. 26. If desired small ball lenses (not shown) or other suitable lenses, may be mounted in counterbores 318 to collimate the laser or other light. The light outputs from the light sources 302 are masked by slits 320 at the lower ends of counterbores 318 which may also help collimate the light beams, if necessary. Preferably, slits 320 conform closely with the cross-sectional shape and dimensions of the channels 20.

Figure 31:
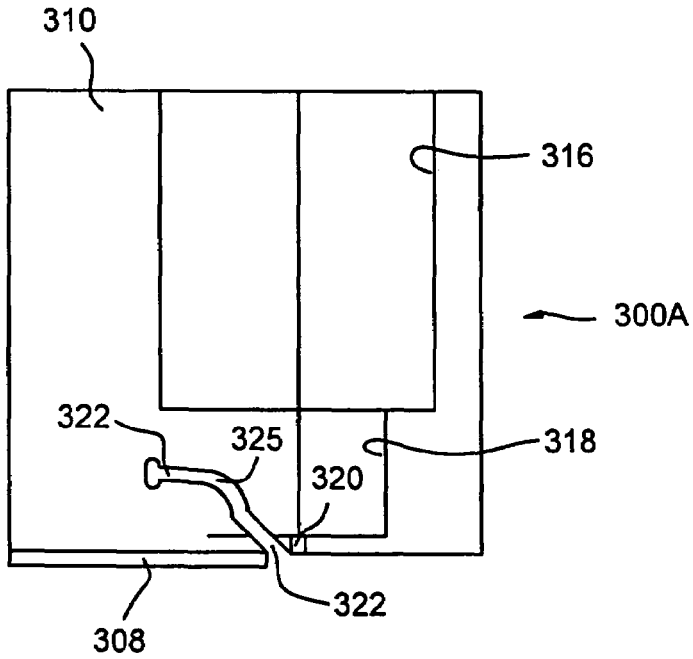
FIG. 31 is an end elevational view of the light holder illustrated in FIG. 26.
Figure 32:
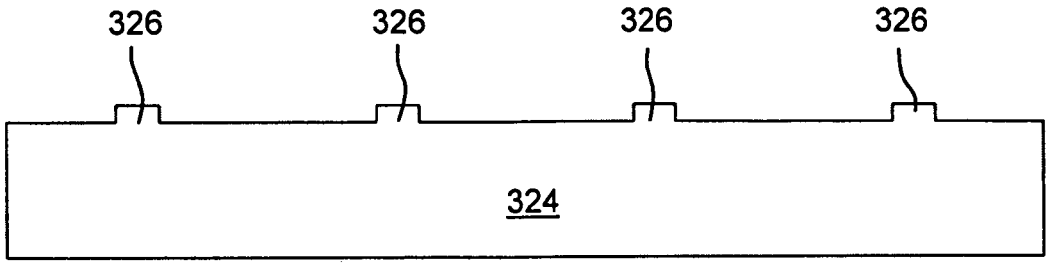
FIG. 32 is a plan view of a mirror insert panel for use in the light holder illustrated in FIG. 26.

A complex slot 322 having the profile indicated in FIG. 31 is cut into block 310 and extends along the length of light holder 300A to receive a mirror insert panel 324 (FIGS. 32-33). Slot 322 opens downwardly across the end faces of feet 308, which are angled at the desired angle of reflection, for example 45°, to receive mirror insert panel 324. Inwardly, slot 322 has a curved portion 325 to bend and grip the mirror insert panel and hold it in place.

Mirror insert panel 324 comprises four small mirrors 326 in the form of tabs extending from one longitudinal edge of the panel and which comprise the reflecting portions of mirror insert panel 324. Mirrors 326 are each dimensioned to fit precisely across a channel 20 and preferably also to occlude the channel against entry of stray light.

Mirror insert panel 324 can be formed from a sheet of metallized film, for example of KAPTON® polymer which is preferably sufficiently thick, e.g. about 1 mil or 25 micron, so as to effectively hold the shape of its reflecting portions when mounted as described herein while still being sufficiently resilient for assembly into slot 322. When mirror insert panel is mounted in slot 322 mirrors 326 each extend across one of the slits 316. Mirror insert panel 324 is held in place by being sprung inside slot 322, disposing and supporting mirrors 326 at 45° to slits 320 and channels 20.

As shown in FIG. 33, where one light source 302 is illustrated assembled with block 310, mirrors 326 reflect at 90° light from light sources 302 which has passed through slits 320. Feet 308 match the dimensions of the channels 20, thus accurately aligning slits 320 and mirrors 326 with channels 20 permitting the light from light sources 320 to travel down channels 20 after reflecting off mirrors 326.

Flexibility

As described in the above example, preferred embodiments of the display materials are thin flexible layers, and more preferably all the layer materials of the display are flexible so that the display itself can be flexed about at least one axis, for storage, shipment, viewing convenience or other purposes as may become apparent. Alternative embodiments can of course have an overall rigid character, if desired, for example by employing a rigid channel plate 15, or other rigid support and can be provided as unique, thin, flat panel displays that are lightweight, low cost and energy saving.

While the invention is not limited by any particular theory, calculations suggest that a flexible shutter array structure and substrate for an exemplary display of about 38 cm. (15 in.) diagonal measure, can be produced according to the invention which can be rolled into a diameter of about 10 cm. (4 in.). Such a rolled or coiled display will have a deformation in the structure, referring particularly to the channel-to-pixel geometry, as low as about 1 percent. The deformation is calculated as the ratio of the pixel width to the radius of deformation, in this case about 5 cm. Such a display structure could, pursuant to the invention, have a thickness of about 1 mm (0.040 in) and pixels about 0.5 mm (0.020 in) wide.

It is contemplated that such a low deformation when flexing can be tolerated by the materials used without significantly affecting the performance and reliability of the display. Efficient operation of the display in a flexed or partially flexed conformation is also contemplated as being feasible. However, such flexed conformation operability, while being an attractive feature, is not essential to the purposes of the invention.

Product Benefits

Display panel 10 is well suited to be embodied in flat panel displays and in thin panel displays which may, optionally, be curved, rolled, folded or otherwise shaped or configured for display, storage or transport purposes. Of particular note is that the three-dimensional contouring of the display may extend into the active display area itself whereby one portion of a coherently displayed image lies substantially out-of-plane with another, possibly adjacent area of the image.

The manufacturing processes of the invention is believed scalable to provide displays up to sizes of 1 meter or more with economical fabrication equipment investment, providing a low cost, high performance displays that can be large, flexible and rugged suitable for large screen high-resolution displays for both computer and television applications.

The high luminous efficacy and luminosity of commercially available LED's in each of the three primary additive colors, red green and blue, enables a particularly bright, low energy, display to be provided. For example, the brightness of a VGA display may exceed 150 cd/m$^2$ and the efficiency can exceed 3 lm/w.

By mounting an RGB group of LED's so that all three of the LEDs in the group emit their light along each light channel 20, each pixel can be red, blue or green or a mixture thereof. By also providing a columnar light channel to serve each pixel in a given row, the drawbacks of RGB subpixels are avoided, and the full area of each addressed pixel can be filled with the light of the characteristics specified at that moment. This makes the display more visibly pleasing, capable of higher resolution and facilitates the manufacturing process.

Unlike other display technologies such as organic light-emitting diodes, nematic liquid crystal, thin film transistors, phosphors and dielectric thin films, electropolymeric displays according to the invention can be made without requiring electronic devices or materials to be synthesized on the display substrate or elsewhere. Consequently, there is no danger of contamination of such sensitive electronic devices or materials by migration of foreign species such as water or oxygen or trace materials as may occur with competing technologies. Such freedom from problems of contamination enhances the reliability of the display.

Use of commercially available manufactured LEDs, or other commercially available light units, instead of synthesizing electronic light source devices on a display substrate gives the displays a consistently predictable optical performance. Furthermore, a plastic substrate, especially a flexible plastic substrate, can be used, without introducing the difficulties of meeting brightness requirements that can arise when attempting to synthesize electronic materials on a plastic rather than a glass substrate, as may be required with other technologies.

Because substantially the entire display structure is plastic, except for the LEDs, it can be made to be highly flexible, to curve or fold around a tight radius, and even to roll up.

Manufacturing and Other Benefits

No electronic devices or materials have to be synthesized on the substrate, channel plate 15, as is necessary with many conventional light-emitting or light-modifying technologies, for example thin film electroluminescent "TFEL", organic light-emitting diode "OLED" displays, supertwisted nematic "STN", and active matrix liquid crystal displays "AMLCD".

Accordingly, the substrate can be an inexpensive plastic component which, unlike the more sophisticated structures needed for other technologies, needs neither a barrier layer nor an orientation layers nor an ITO or equivalent transparent conductive layer.

Channel plate 15 is a mechanical structure and light guide, which can be manufactured as a simple, one-piece plastic substrate, lacking electrodes or other electrical components, by means, for example, of a continuous web process, which can be operated inexpensively.

Shutter array 12 can be fabricated as a composite laminate of three sheets of readily available polymeric materials. Each sheet, aluminum-coated PEN for shutter layer 40, bare polypropylene for dielectric layer 38 and ITO-coated PET for support layer 34, is commonly produced in a web process and the sheets can be web laminated together, resulting in an overall inexpensive component.

The only use of ITO, or equivalent transparent conductive material, is on the PET and it is not patterned into long narrow reaches requiring high conductivity, and therefore does not have to be etched. It is simply a ground plane with a continuous extent across the display are. Therefore the sheet resistivity of the ITO coating layer can be an easily and inexpensively achieved 500 ohm/sq Other technologies employ ITO etched into long, narrow column or row parallel pixel-width electrodes. For higher resolution displays, low sheet resistivity is necessary. State-of-the-art 25-50 ohm/sq on plastic is too high a sheet resistivity for some applications. Even state-of-the-art 7-10 ohm/sq on glass may be too high in some cases.

The voltage signals required by LED assemblies 16 and shutter array 12 are decoupled from each other, avoiding the complexities and row/column voltage trade-offs that usually exist in a multiplexed drive system. Thus, LED assemblies 16 are driven as a sequenced linear array of groups of LEDs and shutters 14 are also driven as a sequenced linear array, in this case an array of rows of shutters. The drive architecture is significantly simplified, substantially simplifying manufacture.

It will be understood that the invention has a number of broad aspects, and concepts embodied in the detailed teachings herein, in addition to the broad statements of invention explicitly set forth hereinabove.

For example, it is believed novel to modulate light furnished to illuminate a strip of pixels at video speeds and to shutter the strip in synchronism with the modulation so as to provide a band component of a video display panel that may serve as a row or column thereof.

Never previously has it been possible to decouple the row and column addressing of a full-color video display so that the x and y axes, the rows and columns, may be driven independently. More specifically, by relegating pixel-specific light modulation to off-display light sources, shutter operation can be effected with very simple drive circuitry and a minimum of conductors. Row-by-row opening and closing of light shutters in a video display, wherein all the shutters in a given row are opened and closed simultaneously, is also believed to be novel.

Nor is it known to pipe or guide light from a single off-display light source to a row or column of pixels in a video display panel. A flexible plastic substrate providing an array of parallel light channels is believed novel, as is the combination of such a substrate with an electrostatic shutter array supported by the substrate and additionally with light sources such as LED assemblies supported along one side of the display area.

A linear array of groups of RGB LED chips mounted on a flexible strip is also believed to be novel.

The invention furthermore provides a novel pixel, namely a pixel which receives a light beam from a source remote from the pixel, in a direction transverse to a direction of viewing, and which has a movable shutter element which can be operated to reflect or deflect the light beam to be turned through an angle, to travel in the direction of viewing.

A further novel feature of the invention comprises an electrostatic reflective shutter employing a prestressed metallized plastic film movable element which element is biased to a fully extended position and operable to move to a reflective position in which the element is largely uncoiled and extends generally at a substantial acute angle, preferably of the order of 45° to the fully extended position to be able to reflect a light beam through a right angle.

An active video display employing color differentiated light-emitting devices rather than filters, that has no electroluminescent devices on or in the display area, is also believed to be novel.

Although the invention has been described with reference to displays having a rectangular display area and an orthogonal matrix array of rectangular (or triangular) pixels, displays having display areas with other geometric shapes are contemplated by the invention. For example, the pixellated display area could be a diamond-shaped, non-rectangular parallelogram, employing triangular pixels, with light guides 20 lying parallel to one another between the shorter sides of the parallelogram. Such a display can employ parallel-sided reflective light channels. However, it may be desirable for the light guides to have a triangular cross-section so that an open shutter element 30 can fully block light from traveling further along the light channel. Other display configurations may similarly conform the light channel cross-sectional shape to the desired display area shape of the shutter element.

Another possible display area shape is circular which circular shape can be provided by employing convergent light channels defined by angularly equi-spaced radial divider walls. The light sources can be positioned around the circumference of the circular display area and the shutter elements can be arranged in concentric rings. Such an arrangement may employ dead areas between adjacent shutters to help accommodate the arcuate display area shape of the shutter elements to the cross sectional shape of the light channel. An advantage of such convergent light channels is that they concentrate the light as it travels away from the light sources, helping to compensate for attenuation due to reflection. Such circular display area shapes with ringed shutter arrays may be used as clock faces, or instrument indicators, for example in automotive instruments, or otherwise, as will be apparent to those skilled in the art.

INDUSTRIAL APPLICABILITY

The present invention finds application in many industrial fields, most notably in the fields of electronic informational, communication and entertainment devices.

Some products of the invention which may comprise novel displays as described hereinabove include: flat panel televisions, including wall-mounted and portable televisions, especially thin flat panel television embodiments; computer monitors or displays including monitors for desktop computers, laptop computers and interactive computerized displays; wallet-sized computers paging devices and portable or cellular telephone devices incorporating information displays; automotive—bullets, instruments and instrumentation displays automotive location all, a trip planning and mapping displays; automotive computer or television displays the under in point-of-sale displays, store window displays especially window displays with animation; outdoor advertising signs all billboards with programmable messages and image displays; the special or bargain or promotional advertising windows, to traffic control does is to transportation displays at the trained loss or boat, at specializes light claim, ticket counter, vehicle destination, departures and arrivals and vehicular advertising information and the like electronic short board shots from all hotel command larger e.g. from one to three meters diagonal dimension; and large green video theaters for broadcast special events and other purposes; and HDTV and other advanced television formats; scoreboards; indoor and outdoor instant replay screens and race result displays; various games, including portable games, arcade equipment, casino games or gaming; environment simulators, for example flight simulators; simulated or electronic publications such as periodic newspapers and magazines; electronic books; and an Internet web site displaying or adapting versions of any of the foregoing.

While illustrative embodiments of the invention have been described, it is, of course, understood that various modifications will be apparent to those of ordinary skill in the art. Many such modifications will be apparent to those of ordinary skill in relevant arts based upon an individual's knowledge of the present state of an art with which they are familiar. Other modifications may become apparent to such individuals as an art develops, for example as materials, products and methods employable in the invention become more economical, more capable or more available. Such modifications are contemplated as being within the spirit and scope of the present invention which is limited and defined only by the appended claims.

The invention claimed is:

1. A pixellated electronic display comprising:

a) a plurality of linear pixel arrays, each linear pixel array including a light guide extending along the pixel array and having:

i) a longitudinally extending optical volume; and ii) a longitudinal light outlet extending along the optical volume;

the light guides being arranged cooperatively, one with another, to provide a display area;

b) for each light guide:

i) a light source to provide a light beam traveling along the optical volume, the light source being electronically switchable between active and inactive states;

ii) a linear array of light-deflecting elements, one for each pixel, disposed along the light guide and each being individually selectable and bendable between an operative position to deflect a light beam traveling along the optical volume to emerge through the light outlet toward a viewer of the display area and a default position where the light beam is not reflected;

wherein, at each pixel, the deflected light beam is effective to change the pixel appearance.

2. An electronic display according to claim 1, being a video display, wherein the bendable shutter elements each have a reflective surface.

3. An electronic video display according to claim 2 wherein, in the default shutter position, the reflective surface of each shutter element is presented to the viewer and the shutter element closes a respective light outlet.

4. An electronic video display according to claim 3 wherein each light source is operable to pulse the light beam in synchronism with operation of the shutters in the respective linear array whereby the light beam pulses are selectively deflected one by each shutter element in the respective linear array.

5. An electronic video display according to claim 4 wherein each light source is selectively operable to generate successive light pulses having different colors, each color being selected from a full color range and wherein each successive light pulse is reflected to the viewer.

6. An electronic video display according to claim 4 wherein each light source comprises a red light-emitting diode device, a green light-emitting diode device, and a blue light-emitting diode device, the light-emitting diode devices, being operable separately to emit their respective colors or in combination to emit combinations of red, green and blue lights.

7. An electronic video display according to claim 6 wherein each shutter element is actuated electrostatically.

8. An electronic video display according to claim 1 wherein the light guides comprise channels in a support member.

9. An electronic video display according to claim 8 wherein the light channels are parallel to one another and wherein the support member comprises opaque divider walls optically separating adjacent channels.

10. An electronic video display according to claim 9 wherein the light channels have reflective inner surfaces throughout their optical lengths.

11. An electronic video display according to claim 9 wherein each light outlet comprises an optical opening along the optical length of a respective light guide and extends transversely of the divider walls.

12. An electronic video display according to claim 1 wherein each optical volume is defined by a respective light outlet and by the inner surfaces of a light channel, all said inner light channel surfaces being reflective.

13. An electronic video display according to claim 12 wherein the light sources each comprise a light-emitting diode device at one end of a light channel, the light-emitting diode device being electronically drivable to emit a light beam into the light volume defined by the light channel.

14. An electronic video display according to claim 13 wherein the bendable shutter elements each have reflective surface.

15. An electronic video display according to claim 14 wherein, in the default shutter position, the reflective surface of each shutter element is presented to the viewer and the shutter element closes a respective light outlet; wherein each light source is operable to pulse the light beam in synchronism with operation of the shutters in the respective linear array whereby the light beam pulses are selectively deflected one by each shutter element in the respective linear array; wherein each light source is selectively operable to generate successive light pulses having different colors, each color being selected from a full color range and wherein the selected light pulse is reflected to the viewer; and wherein each light source comprises a light-emitting diode device capable of separately emitting red light, green light and blue light and combinations of said red green and blue light.

16. An electronic display according to claim 1 constructed of flexible materials and being flexible about at least one axis.

17. An electronic device comprising an electronic display according to claim 1, the device being selected from the group consisting of a television monitor, a computer monitor, a cellular phone, an information appliance, a traffic information sign, a sports scoreboard, a road, water, or air vehicle instrument, a road, water, or air vehicle instrument assembly, a location finder, a household appliance and an industrial appliance.

18. The electronic display according to claim 1, wherein the bendable light deflecting element is bendable to a partially operative position between said operative position and said default position, to partially deflect the light beam.

19. An electronic display comprising:

a) a plurality of light-emitting rows of illumination;

b) a plurality of columns of light switches, each column extending across the rows of illumination and having a switch registering with each crossed row of illumination; and c) electronic drive circuitry to control the emission of light from the rows of illumination and to switch the light switches;

wherein each light switch can be bent between a first position and a second position to reflect light through the respective registering row of illumination toward a viewer.

20. The electronic display of claim 19, wherein each light switch is bendable to a third position between said first position and said second position.

21. An electronic display comprising:

a) a plurality of side-by-side illuminated channels, the illumination of each individual channel being variable independently of the illumination of other channels; and b) a plurality of rows of light switches, each row having one light switch for each channel of illumination;

wherein the light switches are independently bendable between a first position and a second position to reflect light from the respective registering channel of illumination toward a viewer.

22. An electronic video display comprising a plurality of longitudinally extending switchable light columns arranged contiguously one beside the other, each light column comprising:

a) a light channel extending along the column;

b) a switchable light source capable of outputting a light beam along the light channel; and c) a line of light shutters extending alongside the light channel, each light shutter being bendable between a first position and a second position to deflect light from the light beam to travel transversely of the light column toward a viewer.

23. The electronic display of claim 22, wherein each light shutter is bendable to a third position between said first position and said second position.

24. An electronic pixel comprising:

a) a pixel opening having a pixel area in a display plane, the pixel area being viewable by a viewer located on one side of the display plane;

b) an electrostatically actuated bendable light shutter element having a reflective surface and being bent between a default position where the reflective surface extends across the display area to reflect ambient light to the viewer and an operative position where a light beam traveling behind the display plane, with respect to the viewer, is reflected through the pixel opening toward the viewer.

25. A continuous web manufacturing process for manufacturing an electronic pixel as claimed in claim 24.

26. The electronic pixel of claim 24, wherein the bendable light shutter is bendable to a partially operative position between said operative position and said default position, to partially reflect the light beam.

27. A method of manufacturing a pixellated electronic display wherein light from each of a plurality of light sources can be distributed along light channels to an array of electrostatically actuated shutters, the method comprising:

a) assembly of an array of electrostatically bendable shutter elements from polymeric film and conductive materials, the electrostatically bendable shutter elements being bendable between a first position and a second position;

b) assembling the shutter array with a channelized light guide member having a plurality of parallel light channels alignable with the bendable shutter elements; and c) assembling at least one light source with each light channel.

28. A method according to claim 27 wherein the materials employed and the display produced are flexible.

29. The method of claim 27, wherein the electrostatically bendable shutter elements are bendable to a third position between said first position and said second position.

30. A method of displaying a pixellated video image in a display area, the method comprising:

a) directing a series of optically modulatable light beams from an array of light sources in side-by-side parallel bands across the display area;

b) selectively deflecting each directed light beam with a bendable reflector toward the viewer at one of a series of points along the respective display band, the series of points corresponding with a line of pixels in the video image the bendable reflector being bendable between a first position and a second position;

c) selectively deflecting each directed light beam with a bendable reflector toward the viewer at another of the series of points along the respective display band;

d) repeating step c) until each directed light beam has been deflected at all points in the series if required by the desired video image; and e) modulating each light beam at the respective light source while performing steps b) and c) so that each point in each series along each parallel band comprise a pixel of the video image.

31. The method of displaying of claim 30, wherein the bendable reflector is bendable to a third position between said first position and said second position to partially deflect each directed light beam.

32. A light holder for guiding light beams output from multiple light sources into side-by-side light beams, the light holder comprising supports for the multiple light sources and bendable mirrors to turn each of the light beams to travel transversely of the light sources, wherein the light beams are laterally spaced apart and the light beams of one such light holder can be interdigitated between those of another suitable positioned similar light holder so that the beams output from the two light holders are aligned in a plane, the bendable mirrors being bendable between a first position and a second position.

33. The light holder of claim 32, wherein the bendable mirrors are bendable to a third position between said first position and said second position to partially turn each of the light beams.

* * * * *

UNITED STATES PATENT AND TRADEMARK OFFICE

CERTIFICATE OF CORRECTION

PATENT NO. : 7,705,826 B2
APPLICATION NO. : 10/503967
DATED : April 27, 2010
INVENTOR(S) : Charles G. Kalt et al.

It is certified that error appears in the above-identified patent and that said Letters Patent is hereby corrected as shown below:

Col. 42, Line 23 Claim 14, Insert --a-- before "reflective"

Signed and Sealed this
Twenty-sixth Day of April, 2011

David J. Kappos

David J. Kappos
*Director of the United States Patent and Trademark Office*